US011150612B2

(12) United States Patent
Naka et al.

(10) Patent No.: US 11,150,612 B2
(45) Date of Patent: Oct. 19, 2021

(54) PORTABLE RADIO-CONTROLLED WATCH

(71) Applicant: CITIZEN WATCH CO., LTD., Tokyo (JP)

(72) Inventors: Shuji Naka, Fuchu (JP); Ken Kitamura, Nishitokyo (JP); Akira Kato, Tokorozawa (JP); Yohsuke Noma, Koshigaya (JP)

(73) Assignee: CITIZEN WATCH CO., LTD., Tokyo (JP)

( * ) Notice: Subject to any disclaimer, the term of this patent is extended or adjusted under 35 U.S.C. 154(b) by 359 days.

(21) Appl. No.: 16/318,363

(22) PCT Filed: Jul. 20, 2017

(86) PCT No.: PCT/JP2017/026254

§ 371 (c)(1),
(2) Date: Jan. 16, 2019

(87) PCT Pub. No.: WO2018/016574

PCT Pub. Date: Jan. 25, 2018

(65) Prior Publication Data

US 2019/0265655 A1 Aug. 29, 2019

(30) Foreign Application Priority Data

Jul. 20, 2016 (JP) ..... JP2016-142441

(51) Int. Cl.
*G04R 60/08* (2013.01)
*H01Q 1/27* (2006.01)
(Continued)

(52) U.S. Cl.
CPC ..... *G04R 60/08* (2013.01); *G04G 21/04* (2013.01); *G04R 60/10* (2013.01); *H01Q 1/273* (2013.01)

(58) Field of Classification Search
CPC ..... G04R 60/08; G04R 60/10; G04R 60/12; G04G 21/04; H01Q 1/273; H01Q 7/00; H01Q 9/42; H01Q 5/378
(Continued)

(56) References Cited

U.S. PATENT DOCUMENTS 5,768,217 A 6/1998 Sonoda et al.
8,467,272 B2 * 6/2013 Fujisawa ..... G04C 10/02 368/47

(Continued)

FOREIGN PATENT DOCUMENTS

CN 1196614 A 10/1998
CN 1701464 A 11/2005

(Continued)

OTHER PUBLICATIONS

Office Action dated Apr. 2, 2020, for relating CN Patent Applications No. 201780020432.0 with partial English translation.

(Continued)

*Primary Examiner* — Edwin A. Leon
(74) *Attorney, Agent, or Firm* — HEA Law PLLC

(57) ABSTRACT

A portable radio-controlled watch includes a watch glass, an antenna that is formed on a backside of a circumference of the watch glass so as to be along the circumference, a feeder electrode adjacent to the antenna, a receiving circuit, an antenna connecting line that is at least a part of a connection circuit connecting the feeder electrode with the receiving circuit, where the antenna connecting line is directly connected to a back surface of the feeder electrode and extends in a direction away from the watch glass, and a dielectric that is disposed below the antenna and covers at least a part of the antenna in a plan view.

13 Claims, 45 Drawing Sheets

(51) Int. Cl.
*G04G 21/04* (2013.01)
*G04R 60/10* (2013.01)

(58) Field of Classification Search
USPC ..... 368/10
See application file for complete search history.

(56) References Cited

U.S. PATENT DOCUMENTS

| | | | | |
|---|---|---|---|---|
| 8,897,099 | B2 | 11/2014 | Fujisawa | |
| 8,964,511 | B2 | 2/2015 | Fujisawa | |
| 9,568,892 | B2 * | 2/2017 | Fujisawa | G04G 21/04 |
| 2006/0109188 | A1 | 5/2006 | Ikeda et al. | |
| 2011/0102274 | A1 | 5/2011 | Fujisawa | |
| 2012/0120772 | A1 | 5/2012 | Fujisawa | |
| 2012/0170423 | A1 | 7/2012 | Fujisawa | |
| 2012/0213039 | A1 | 8/2012 | Aizawa et al. | |
| 2014/0029388 | A1 | 1/2014 | Fujisawa | |
| 2014/0085153 | A1 | 3/2014 | Nagahama | |
| 2014/0086020 | A1 | 3/2014 | Fujisawa | |
| 2014/0232603 | A1 | 8/2014 | Fujisawa | |
| 2015/0016229 | A1 | 1/2015 | Yanagisawa et al. | |
| 2015/0220066 | A1 | 8/2015 | Fujisawa | |
| 2015/0277389 | A1 * | 10/2015 | Saito | G04R 60/10 368/205 |
| 2016/0054711 | A1 | 2/2016 | Fujisawa | |
| 2017/0040701 | A1 | 2/2017 | Hanabusa | |

FOREIGN PATENT DOCUMENTS

| | | | |
|---|---|---|---|
| CN | 101273306 | A | 9/2008 |
| CN | 101715615 | A | 5/2010 |
| CN | 102081347 | A | 6/2011 |
| CN | 102591192 | A | 7/2012 |
| CN | 102651500 | A | 8/2012 |
| CN | 103676636 | A | 3/2014 |
| CN | 103676637 | A | 3/2014 |
| CN | 104007656 | A | 8/2014 |
| CN | 104137005 | A | 11/2014 |
| CN | 204576093 | U | 8/2015 |
| JP | H05223959 | A | 9/1993 |
| JP | H076788 | U | 1/1995 |
| JP | H08285960 | A | 11/1996 |
| JP | H09-307329 | A | 11/1997 |
| JP | H10-197662 | A | 7/1998 |
| JP | 2003-315475 | A | 11/2003 |
| JP | 2006-112832 | A | 4/2006 |
| JP | 2010223784 | A | 10/2010 |
| JP | 2012118045 | A | 6/2012 |
| JP | 2013050340 | A | 3/2013 |
| JP | 2013050370 | A | 3/2013 |
| JP | 2013-178190 | A | 9/2013 |
| JP | 2014-062844 | A | 4/2014 |
| JP | 2014-163666 | A | 9/2014 |
| JP | 2015-143664 | A | 8/2015 |
| JP | 2015-207855 | A | 11/2015 |
| JP | 2016121990 | A | 7/2016 |
| JP | 2017-032506 | A | 2/2017 |
| WO | 2007037465 | A2 | 4/2007 |
| WO | 2008101119 | A1 | 8/2008 |

OTHER PUBLICATIONS

Office Action of Apr. 2, 2020, for relating CN Patent Application No. 201780021549.0 with partial English translation.
Office Action dated Jun. 22, 2020, for corresponding CN application No. 201780044353.3 with partial English translation.
Office Action dated Jun. 30, 2020, for relating JP application No. 2016-151530 with partial English translation.
Office Action dated Jun. 30, 2020, for relating JP application No. 2016-201020 with partial English translation.
English Translation of International Search Report for PCT/JP2017/026254 dated Oct. 24, 2017.
English Translation of International Search Report for PCT/JP2017/010765 dated Jun. 20, 2017.
English Translation of International Search Report for PCT/JP2017/010764 dated Jun. 20 2017.
Office Action dated Jul. 6, 2021, for corresponding JP Patent Application No. 2018-528861 with partial English translation pp. 1-7.

* cited by examiner

PORTABLE RADIO-CONTROLLED WATCH

CROSS REFERENCE TO RELATED APPLICATIONS

This application is a National Stage of International Application No. PCT/JP2017/026254 filed on Jul. 20, 2017, which claims priority from Japanese Patent Application 2016-142441, filed on Jul. 20, 2016. The contents of the above documents are incorporated herein by reference in their entirety.

TECHNICAL FIELD

The present invention relates to a portable radio-controlled watch that receives a signal from a satellite, for example.

BACKGROUND ART

Portable radio-controlled watches that receive time information included in a transmission signal from a satellite configuring GPS (Global Positioning System), for example, to correct time have increased their practical applications. Types and placement of antennas for receiving radio waves are determined so as not to deteriorate the operability of the watch and to obtain necessary reception sensitivity.

FIG. 8 of Patent Literature 1 discloses placing the parasitic element 423 (antenna) in the backside of the outer circumference of the watch glass. The parasitic element 423 is fed by the arc-shaped fed element 410 formed on the dielectric in a non-contact manner. The dial ring 83, which is a dielectric, is disposed between the parasitic element 423 and the fed element 410.

Patent Literature 2 discloses the antenna 40 including the parasitic element 402 and the driven element 403 that are disposed on the annular dielectric 401. The antenna is not disposed on the watch glass, and the dial ring 83 is disposed between the antenna 40 and the watch glass.

CITATION LIST

Patent Literature

Patent Literature 1: JP2014-163666A
Patent Literature 2: JP2014-62844A

SUMMARY OF INVENTION

Technical Problem

The inventors of the present invention consider including a highly sensitive antenna for a UHF band in a portable watch, such as a wristwatch. In this case, the wavelength needs to be shortened by the dielectric so that the antenna is accommodated in the portable watch. Here, as shown in FIG. 8 of Patent Literature 1, if the dielectric having a certain thickness is disposed between the parasitic element (antenna) on the watch glass and the underlying fed element, a loss will occur in the high-frequency received signal by the dielectric. Further, even without the dielectric, the reception sensitivity can be lowered due to the distance. On the other hand, as indicated in Patent Literature 2, if the antenna is disposed at the position away from the watch glass, the antenna is susceptible to the case or the circuit of the portable watch, which results in lowered sensitivity or increased thickness.

One or more embodiments of the present invention have been conceived in view of the above, and an object thereof is to provide a highly sensitive and thin portable radio-controlled watch.

Solution to Problem (1) A portable radio-controlled watch includes a watch glass, an antenna that is disposed on an one surface of the watch glass along a circumference of the watch glass, a feeder electrode that is adjacent to the antenna in a direction perpendicular to a thickness direction of the antenna, a receiving circuit, an antenna connecting line that is at least a part of a connection circuit connecting the feeder electrode with the receiving circuit, the antenna connecting line being electrically connected to the feeder electrode and extending in a direction away from the watch glass, and a dielectric that is disposed near the antenna and covers at least a part of the antenna in a plan view.

(2) In (1), the antenna includes a first part that is adjacent to the feeder electrode and a second part that is not adjacent to the feeder electrode, and a width of the first part is smaller than a width of the second part.

(3) In (1) or (2), the antenna is not disposed on the circumference side of an area of the feeder electrode and on a side opposite to the area of the feeder electrode, where the area of the feeder electrode is in contact with the antenna connecting line.

(4) In any one of (1) to (3), the antenna is disposed closer to the circumference side of the watch glass than the feeder electrode.

(5) In any one of (1) to (3), the feeder electrode is disposed closer to the circumference side of the watch glass than the antenna.

(6) In (5), the portable radio-controlled watch further includes a bezel or a body into which the watch glass is fitted, wherein the bezel or the body has a notch at a position opposite to the antenna connecting line.

(7) In any one of (1) to (5), the portable radio-controlled watch further includes a bezel into which the watch glass is fitted, wherein the dielectric is a part of the bezel and disposed immediately below the antenna.

(8) In any one of (1) to (5), the portable radio-controlled watch further includes a bezel into which the watch glass is fitted, wherein the dielectric is a part of the bezel, and an insulating member is disposed between the antenna and the dielectric.

(9) In any one of (1) to (5), the portable radio-controlled watch further includes a bezel into which the watch glass is fitted and including a dielectric disposed below the antenna, and a high dielectric member that is disposed between the dielectric and the antenna and has a higher permittivity than the dielectric.

(10) In any one of (1) to (5), the portable radio-controlled watch further includes a bezel into which the watch glass is fitted and including a metal member and a dielectric member.

(11) In any one of (1) to (10), the portable radio-controlled watch further includes a hiding member between the antenna and the watch glass.

(12) In any one of (1) to (11), the circumference of the watch glass is inclined at a front side.

Advantageous Effects of Invention

According to the present invention, the portable radio-controlled watch can receive radio waves with high sensitivity and be made thin.

DESCRIPTION OF EMBODIMENTS

An embodiment of the present invention will be described below in detail with reference to the accompanying drawings.

First Embodiment

In the following, a satellite radio-controlled wristwatch 1 according to an embodiment of the present invention will be described. The satellite radio-controlled wristwatch 1 according to this embodiment receives a satellite radio wave including time information, and adjusts time that the satellite radio-controlled wristwatch 1 counts and measures position by using the time information included in the received satellite radio wave.

Figure 1:
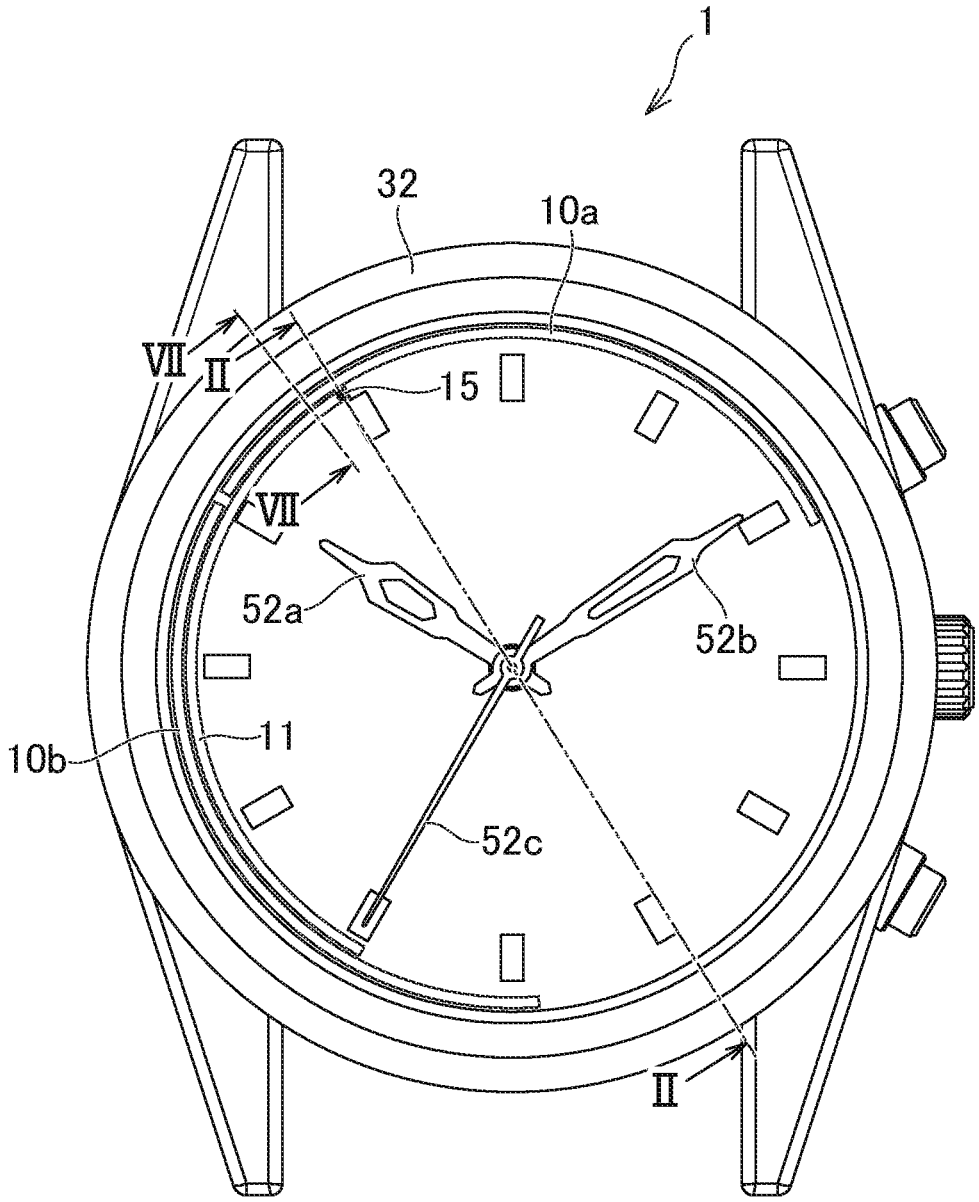
FIG. 1 is a plan view illustrating an example of a satellite radio-controlled wristwatch according to a first embodiment.
Figure 2:
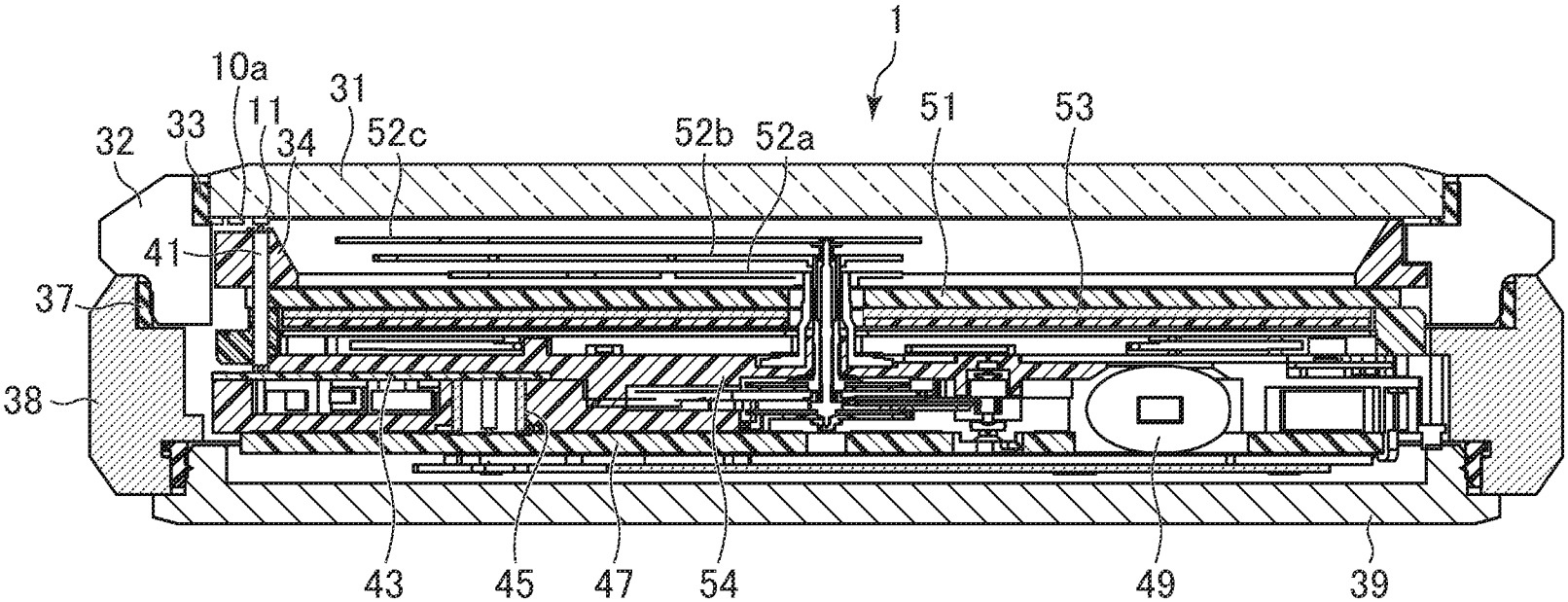
FIG. 2 is a cross-sectional view of the satellite radio-controlled wristwatch shown in FIG. 1 taken along the line II-II.

FIG. 1 is a plan view illustrating an example of an appearance of the satellite radio-controlled wristwatch 1 according to an embodiment of the present invention. FIG. 2 is a cross-sectional view of the satellite radio-controlled wristwatch 1 shown in FIG. 1 taken along the line II-II. As shown in FIGS. 1 and 2, the satellite radio-controlled wristwatch 1 includes a watch glass 31, a bezel 32 for holding the watch glass 31, a cylindrical body 38, and a back cover 39 below the body 38. These configure the outline of the satellite radio-controlled wristwatch 1. The watch glass 31 includes a transparent material, such as sapphire glass. The body 38 and the bezel 32 are disposed between the watch glass 31 and the back cover 39. In the following, a direction from the center of the satellite radio-controlled wristwatch 1 to the watch glass 31 is described as "up", "upper", "upward", and "top", and a direction to the back cover 39 is described as "low", "lower", "downward", "below", and "bottom", for example. Further, a direction from the center of the watch glass 31 to the circumference of the watch glass 31 is described as "outside" or "circumference side", a direction from the circumference to the center is described as "inside."

The body 38 is made of metal and has a hole vertically penetrating therethrough. The bezel 32 is annular ceramics corresponding to the shape of the upper end of the hole of the body 38, and is fitted into the upper end of the hole, thereby connecting to the body 38. The back cover 39 is made of metal, and has a plane corresponding to the shape of the lower end of the hole of the body 38. The back cover 39 is fitted into the lower end of the hole. The watch glass 31 has a flat surface corresponding to the shape of the upper end of the opening of the bezel 32, and is fitted into the upper end of the opening of the bezel 32. The watch glass 31 is in contact with the bezel 32 via a packing 33, and the watch glass 31 is fixed by the packing 33. The bezel 32 is in contact with the body 38 via a packing 37, and the bezel 32 is fixed by the packing 37.

The satellite radio-controlled wristwatch 1 includes antennas 10*a* and 10*b*, feeder electrodes 11, conductive pins 41, an annular dial ring 34, a dial plate 51, an hour hand 52*a*, a minute hand 52*b*, a second hand 52*c*, a solar cell 53, a main plate 54, a wiring substrate 43, a coaxial pin 45, a circuit substrate 47, and a motor 49. These are disposed in space surrounded by the watch glass 31, the bezel 32, the body 38, and the back cover 39.

The antennas 10*a* and 10*b* are disposed below (back of) the watch glass 31 so as to extend along the circumference of the watch glass 31. In the example of FIG. 1, each of the antennas 10*a* and 10*b* is arc-shaped, and bonded to the backside of the watch glass 31. The antennas 10*a* and 10*b* receive satellite signals from the satellite. In this embodiment, the antennas 10*a* and 10*b* are what we call dipole antennas, and receive radio wave having a frequency of about 1.6 GHz transmitted from a Global Positioning System (GPS) satellite. GPS is a type of satellite positioning system, which is constructed by GPS satellites orbiting around the earth.

The feeder electrode 11 is disposed so as to be adjacent to a part of the antennas 10*a* and 10*b*. In the examples of FIGS. 1 and 2, the feeder electrode 11 is disposed radially inward of the antennas 10*a* and 10*b* in a plan view. In other words, the feeder electrode 11 is adjacent to the antennas 10*a* and 10*ba* in a direction perpendicular to the thickness direction of the antennas 10*a* and 10*b*. One end of the antenna 10*a* is adjacent to one end of the antenna 10*b*. A part of the antenna 10*a* close to the one end is adjacent to the feeder electrode 11, and a part of the antenna 10*b* close to the one end is adjacent to the feeder electrode 11. The feeder electrode 11 may be disposed closer to the circumference than the antennas 10*a* and 10*b*. One end of the feeder electrode 11 includes a connection area 15 in contact with the conductive pins 41. The antennas 10*a* and 10*b* may be directly adjacent to the feeder electrode 11, or may be adjacent to the feeder electrode 11 via a some kind of member.

The conductive pins 41 are what we call probe pins. The number of the conductive pins 41 is the same as the number of the feeder electrodes 11, and the feeder electrodes 11 are electrically connected to the wiring substrate 43 by the corresponding conductive pins 41. Each end of a conductive pin 41 is elastic by a spring, and the upper end of the conductive pin 41 is in contact with the feeder electrode 11. The lower end of the conductive pin 41 is in contact with a connecting terminal provided on the wiring substrate 43. The conductive pin 41 is fixed by the dial ring 34 and the main plate 54 in a plan view. In the example of FIG. 2, the conductive pin 41 is fixed in a hole vertically penetrating the dial ring 34. When viewed from the feeder electrode 11, the conductive pin 41 extends in a direction away from the watch glass 31. The receiving circuit 22 and the feeder electrode 11 may be directly connected to each other without the wiring substrate 43 between them.

Figure 3:
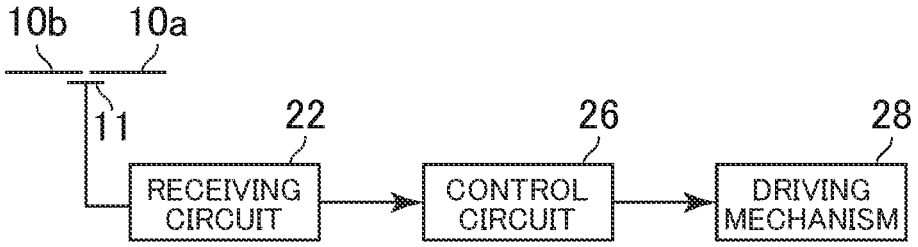
FIG. 3 is a block diagram showing a schematic circuit configuration of the satellite radio-controlled wristwatch.

FIG. 3 is a block diagram showing a schematic circuit configuration of the satellite radio-controlled wristwatch 1. The receiving circuit 22 receives an unbalancing signal, which is received by the antennas 10*a* and 10*b*, via the feeder electrode 11. The receiving circuit 22 decodes the signal received by the antennas 10*a* and 10*b*, and outputs a bit string (received data) indicating content of a satellite signal obtained by the decoding. More specifically, the receiving circuit 22 includes a high frequency circuit (RF circuit) and a decoding circuit. The high frequency circuit operates at high frequency, and amplifies and detects an analog signal received by the antennas 10*a* and 10*b* to convert the analog signal into a baseband signal. The decoding circuit decodes the baseband signal output from the high frequency circuit to generate a bit string indicating data received from the GPS satellite, and outputs the bit string to the control circuit 26.

The control circuit 26 controls the circuits and the system included in the satellite radio-controlled wristwatch 1, and includes a microcontroller, a motor drive circuit, and an RTC (Real Time Clock), for example. The control circuit 26 acquires a time based on the received data and a clock output from the RTC, and drives the motor 49 included in a driving mechanism 28 in accordance with the acquired time. The driving mechanism 28 includes the motor 49, which is a step motor, and a gear train. The motor 49 is provided on a surface of the circuit substrate 47 on the side of the dial plate 51. The gear train transmits rotation of the motor 49, thereby causing one of the hour hand 52*a*, the minute hand 52*b*, and the second hand 52*c* to turn, for example. The current time is displayed in this way.

Figure 4:
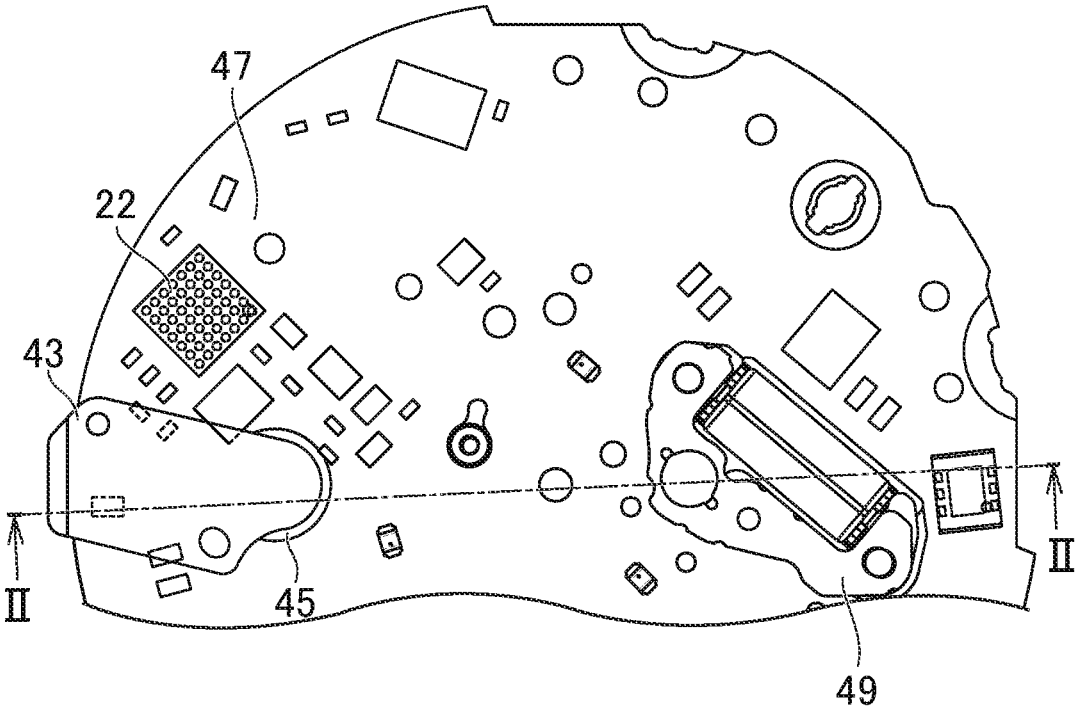
FIG. 4 is a plan view of a circuit substrate and a wiring substrate included in the satellite radio-controlled wristwatch shown in FIG. 1.
Figure 5:
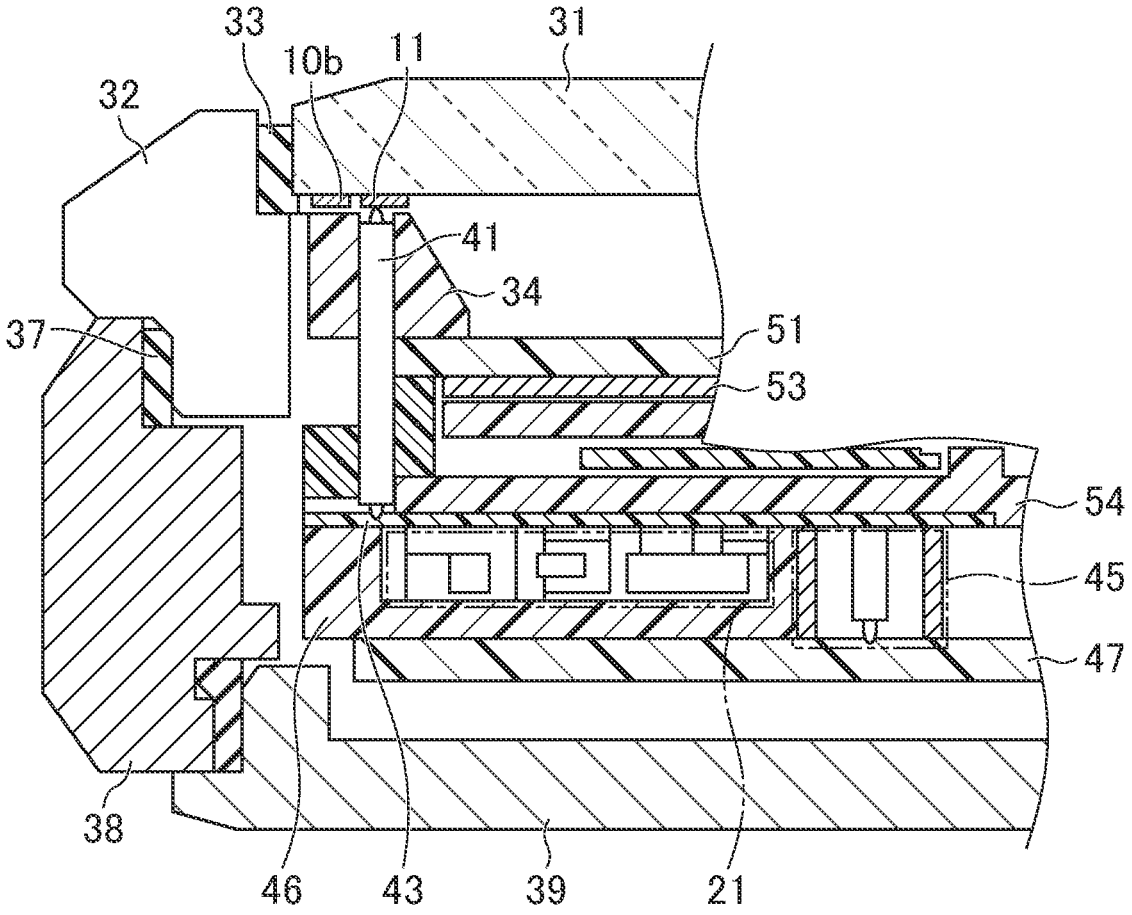
FIG. 5 is a partial enlarged view of the cross section shown in FIG. 2.

Next, placement of the receiving circuit 22 etc., will be described. FIG. 4 is a plan view of the circuit substrate 47 and the wiring substrate 43 included in the satellite radio-controlled wristwatch 1 shown in FIG. 1. The cutting line II-II shown in FIG. 4 corresponds to the cross section shown in FIG. 2. FIG. 5 is a partial enlarged view of the cross section shown in FIG. 2. The wiring substrate 43 is disposed on the circuit substrate 47. The receiving circuit 22 is disposed on the circuit substrate 47. In the example of FIG. 4, the receiving circuit 22 is disposed next to the wiring substrate 43 in a plan view. The wiring substrate 43 does not overlap the motor 49 and a battery in a plan view.

A spacer 46 made of resin is disposed between the wiring substrate 43 and the circuit substrate 47, and keeps a space between the wiring substrate 43 and the circuit substrate 47. The wiring substrate 43 and the circuit substrate 47 are disposed in parallel to each other. The spacer 46 is disposed between the wiring substrate 43 and the circuit substrate 47, but a metal member, such as GND wiring, is not disposed between the wiring substrate 43 and the circuit substrate 47. The solar cell 53 is disposed immediately below the dial plate 51, and a main plate 54, for example, is disposed between the solar cell 53 and the wiring substrate 43 or the circuit substrate 47.

A connecting terminal connected to the conductive pin 41, a terminal connected to the coaxial pin 45, and intermediate wiring electrically connecting these terminals are disposed on the wiring substrate 43. The intermediate wiring extends to the wiring substrate 43 from the connecting terminal of the conductive pin 41. When viewed from the connecting terminal, the intermediate wiring extends away from the body 38. The intermediate wiring and the receiving circuit 22 are connected to each other by RF connection wiring. The RF connection wiring includes the coaxial pin 45, the terminal on the wiring substrate 43 for connecting the coaxial pin 45 and the intermediate wiring, and wiring on the circuit substrate 47 for connecting the coaxial pin 45 and the receiving circuit 22. The coaxial pin 45 electrically connects the wiring on the wiring substrate 43 to the wiring on the circuit substrate 47. The coaxial pin 45 is closer to the center of the dial plate 51 than the conductive pins 41 in a plan view, and further away from the body 38 than the conductive pins 41. The conductive pins 41, the intermediate wiring, and the RF connection wiring are a connection circuit that connects the feeder electrode 11 to the receiving circuit 22. The conductive pin 41 is a type of wiring that connects the feeder electrode 11 to the receiving circuit 22.

Figure 6:
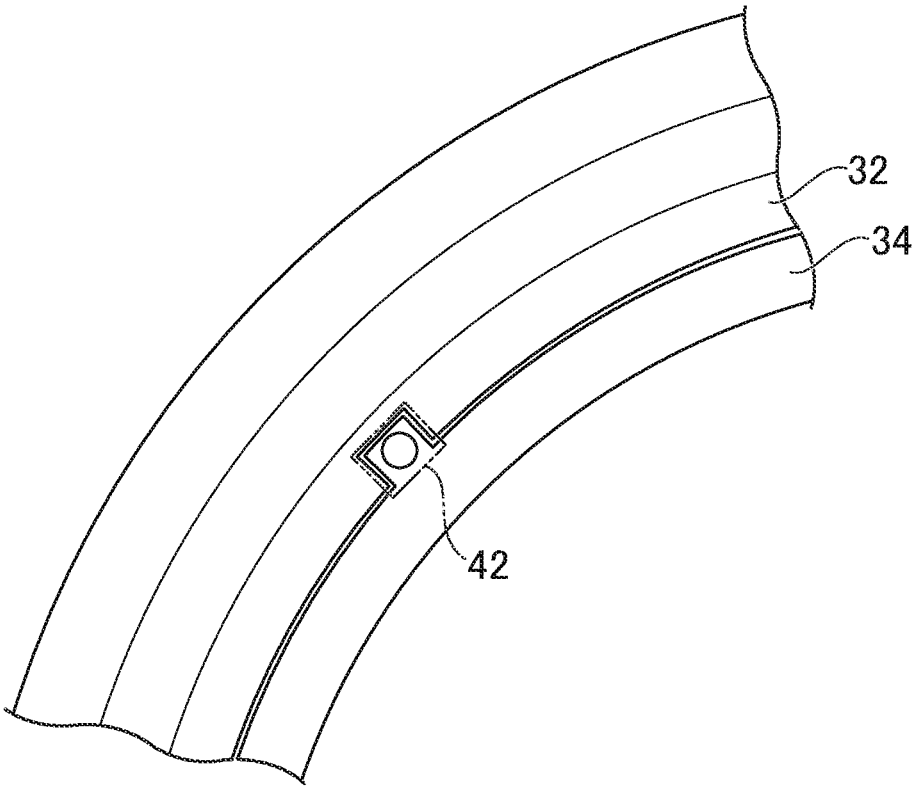
FIG. 6 is a partial plan view of a bezel and a dial ring.

The bezel 32 has a notch 42 at a position where the conductive pin 41 is inserted in the inner circumferential surface. FIG. 6 is a partial plan view of the bezel 32 and the dial ring 34. The bezel 32 includes a part outside of the circumference of the watch glass 31 and a projection 35 (see FIG. 7) projecting inward from the outside part in a plan view. The notch 42 is provided on the projection 35 in the vicinity of the conductive pin 41. In a plan view, the dial ring 34 on the inner circumference side of the bezel 32 is provided at the position of the notch 42, and a hole is provided in an area where the dial ring 34 overlaps the notch 42 so as to fix the conductive pin 41. The conductive pin 41 is disposed so as to be inserted into the hole.

The notch 42 may not necessarily be provided in the bezel 32. Without the notch 42, the conductive pin 41 is disposed inside of the inner circumferential surface of the bezel 32 in a plan view. In this case, only an area of the feeder electrode 11 that is in contact with the conductive pin 41 and a portion in the vicinity of the area may be projected inward. This enables the feeder electrode 11 to obtain a wavelength-shortening effect by the bezel 32.

Figure 7:
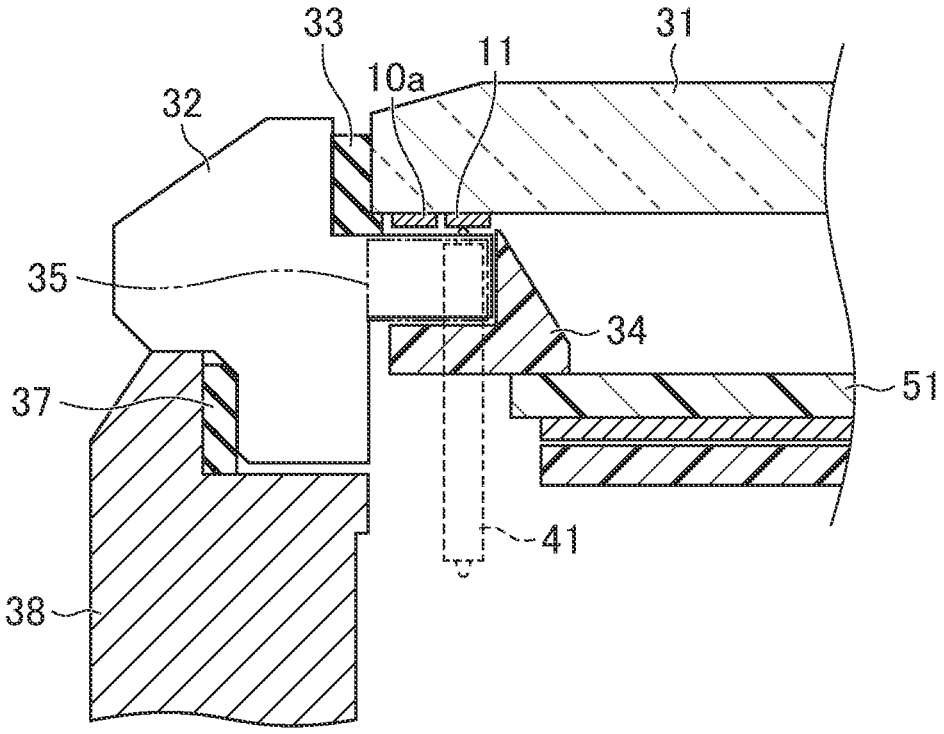
FIG. 7 is a cross-sectional view of the satellite radio-controlled wristwatch shown in FIG. 1 taken along the line VII-VII.

Next, relationship between the antennas 10*a* and 10*b*, the feeder electrode 11, and the peripheral members will be described in more detail. FIG. 7 is a cross-sectional view of the satellite radio-controlled wristwatch 1 shown in FIG. 1 taken along the line VII-VII. In FIG. 7, the conductive pin 41 is on the other side of the cross section, and indicated in dashed line.

The bezel 32 is formed of ceramics having dielectric properties, and the projection 35 covers at least a part of the antennas 10*a* and 10*b* and the feeder electrode 11 which are disposed in the circumferential edge of the watch glass 31 in a plan view. The projection 35 is disposed immediately below at least a part of the antennas 10*a* and 10*b* and the feeder electrode 11, and formed in a shape of notched ring. In the example of this embodiment, the projection 35 is disposed immediately below a part of the antennas 10*a* and 10*b* and the feeder electrode 11 other than the part connected to the conductive pin 41. The dial ring 34 is made of an insulating material, such as resin, and disposed so as to be adjacent to the inner circumference of the bezel 32. The dial ring 34 is also disposed so as to be below and adjacent to the projection 35.

In this embodiment, antennas 10*a* and 10*b* and the feeder electrode 11 are disposed on the backside of the watch glass 31, and the bezel 32 (in particular, projection 35), which is a dielectric, is disposed below the antennas 10*a* and 10*b* and the feeder electrode 11. In this embodiment, the dielectric (here, bezel 32) below the antennas 10*a* and 10*b* and the feeder electrode 11 provides the wavelength-shortening effect. Further, the conductive pin 41 and the feeder electrode 11 are directly connected to each other and the feeder electrode 11 is disposed in the vicinity of the antennas 10*a* and 10*b*, thereby preventing decrease of sensitivity. This can make the satellite radio-controlled wristwatch 1 to be thinner with higher sensitivity compared to the one without this configuration. The dielectric may not be disposed below the feeder electrode 11. In this case, the feeder electrode 11 may be shaped in view of the existence of wavelength-shortening effect.

As shown in FIG. 7, the circumference of the watch glass 31 on the front side (upper surface) has an inclined area, and the antennas 10*a* and 10*b* and the feeder electrode 11 are covered by the inclined area. A planar area, which has a normal line extending upward, is provided inner side of the inclined area. More specifically, when a direction from a position on the watch glass 31 to the center of the watch glass 31 is r direction in a plan view, the inclined area is provided from the edge of the watch glass 31 on the front side to the inner area of the outer edge of the antennas 10*a* and 10*b* and the feeder electrode 11 in the r direction. The inclined area covers the antennas 10*a* and 10*b* and the feeder electrode 11 in a plan view. In the inclined area, the normal line is inclined outward from the top, and the outer edge of the inclined area is lower than the inner edge. This configuration makes the antennas 10*a* and 10*b* and the feeder electrode 11 less visible, and serves to enhance the design. In the example of FIG. 7, an angle of the inclination of the inclined area is constant in the cross section through the center of the satellite radio-controlled wristwatch 1.

Figure 26:
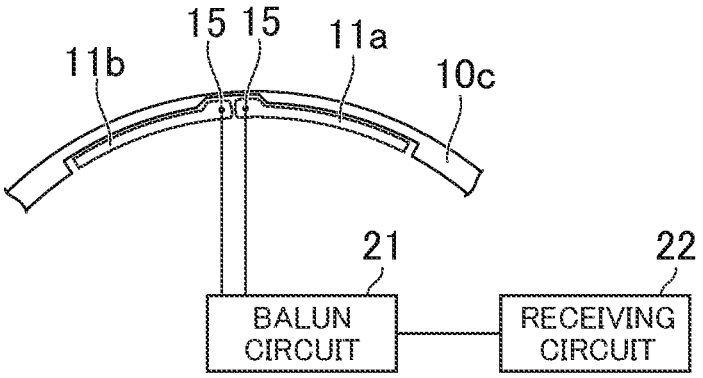
FIG. 26 is a schematic diagram of an example of placement of an antenna and feeder electrodes.

Here, a signal may be received using two feeder electrodes 11*a* and 11*b*. FIG. 26 is a schematic diagram of an example of placement of the antenna 10*i* and the feeder electrodes 11*a* and 11*b*. FIG. 26 is a diagram corresponding to the antennas 10*a* and 10*b* and the feeder electrode 11 shown in FIG. 1 and a part of the circuit configuration shown in FIG. 3. In the example of FIG. 26, the number of feeder electrodes 11*a* and 11*b* is two, and the feeder electrodes 11*a* and 11*b* are adjacent to the antenna 10*i*. The feeder electrodes 11*a* and 11*b* are disposed so as to be on the back side of the watch glass 31 and side by side on the same arc in a plan view. Each of the feeder electrodes 11*a* and 11*b* includes a connection area 15 for contacting the conductive pin 41. The connection areas 15 of the feeder electrodes 11*a* and 11*b* are adjacent to each other, and a width of the connection area is larger than other area. The width of the antenna 10*i* is narrower where the antenna 10*i* is adjacent to the feeder electrodes 11*a* and 11*b*. When a part of the feeder electrodes 11*a* and 11*b* other than the connection areas 15 is referred to as an arc-shaped area, the width of the antenna 10*i* is narrower where the antenna 10*i* is adjacent to the connection area 15 than where the antenna 10*i* is adjacent to the arc-shaped area. In the example of FIG. 26, the antenna 10*i* is not divided.

In the example of FIG. 26, the feeder electrodes 11*a* and 11*b* output received signals having balanced characteristics. In order to connect this balanced received signal to the coaxial pin 45 and the receiving circuit 22 having unbalanced characteristics, the balun circuit 21 converts the balanced received signal from the feeder electrodes 11*a* and 11*b* into an unbalanced received signal. The balun circuit 21 is connected to each of the feeder electrodes 11*a* and 11*b*, and output unbalanced signals to the receiving circuit 22. The balun circuit 21 may be disposed on the bottom surface of the wiring substrate 43 in FIG. 4.

The relationship between the antennas 10*a* and 10*b*, the feeder electrodes 11, and the dielectric may be different from the description above.

Figure 8:
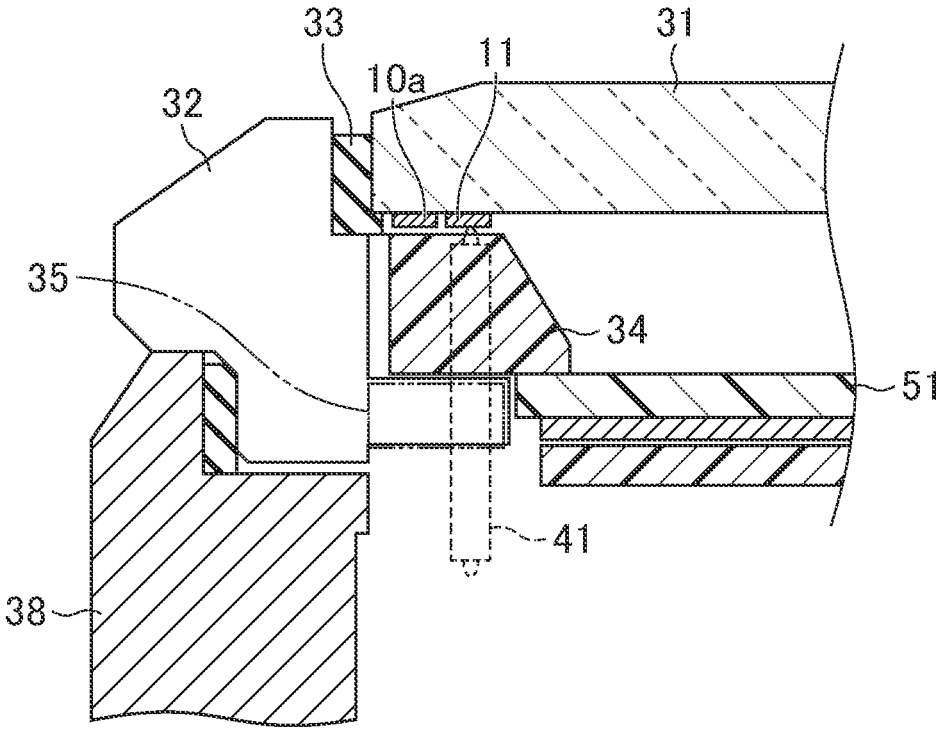
FIG. 8 is a partial sectional view illustrating another example of the satellite radio-controlled wristwatch.

FIG. 8 is a partial sectional view of another example of the satellite radio-controlled wristwatch 1, and a cross-sectional view corresponding to FIG. 7. In the following, a difference between examples of FIG. 7 and FIG. 8 will be mainly described. In the example of FIG. 8, the dial ring 34 is disposed between the projection 35 and the combination of the antennas 10*a*, 10*b*, and the feeder electrode 11. As such, in the example of FIG. 8, the projection 35 of the bezel 32 is disposed so as not to extend over the upper surface of the dial plate 51. In this regard, a part of the dial ring 34 opposing to the projection 35 may be thinned so that the projection 35 is disposed more upward. If the dial ring 24 includes a dielectric material, it is possible to prevent the sensitivity from being lowered while achieving the wavelength-shortening effect with this configuration. The permittivity of the dial ring 34 may be higher than that of the projection 35. This provides a greater wavelength-shortening effect. In this regard, if the dial ring 34 is simply an insulator, such as resin, it is possible to prevent the sensitivity from being lowered as in the example of FIG. 7, although the wavelength-shortening effect is low.

Figure 9:
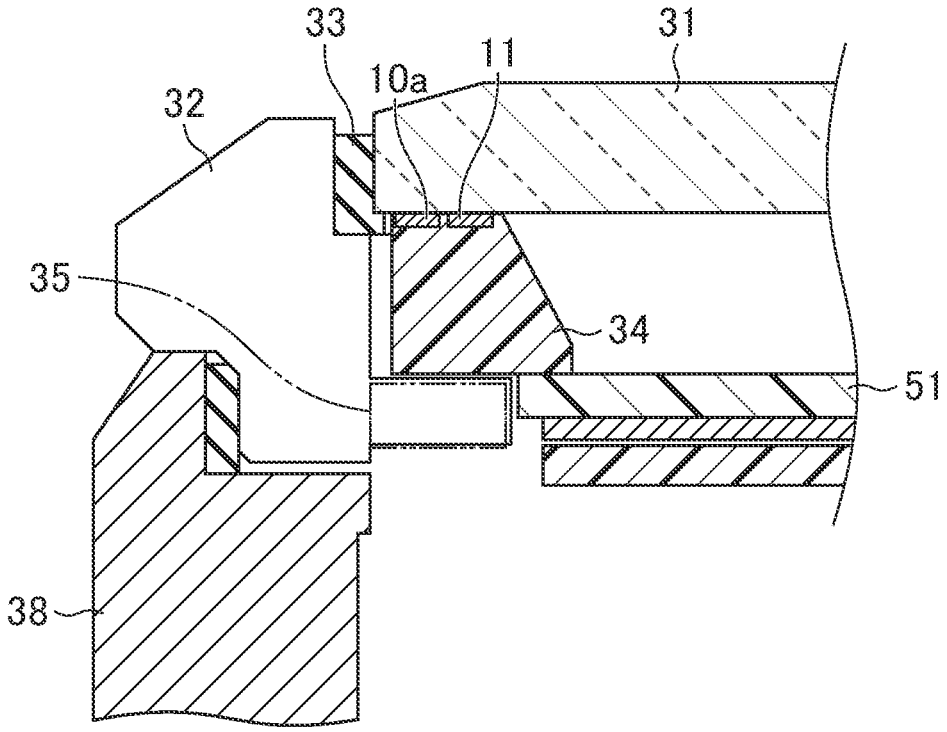
FIG. 9 is a partial sectional view illustrating another example of the satellite radio-controlled wristwatch.

FIG. 9 is a partial sectional view illustrating another example of the satellite radio-controlled wristwatch 1, and corresponds to FIG. 8. In the example of FIG. 9, a recess is formed on the upper surface of the dial ring 34 in order to fit the shape of the antennas 10*a* and 10*b* and the feeder electrode 11. The antennas 10*a* and 10*b* and the feeder electrode 11 are adjacent to the dial ring 34 not only at the lower sides but also at the circumferences and the inner sides in the recess. This provides a greater wavelength-shortening effect.

Figure 10:
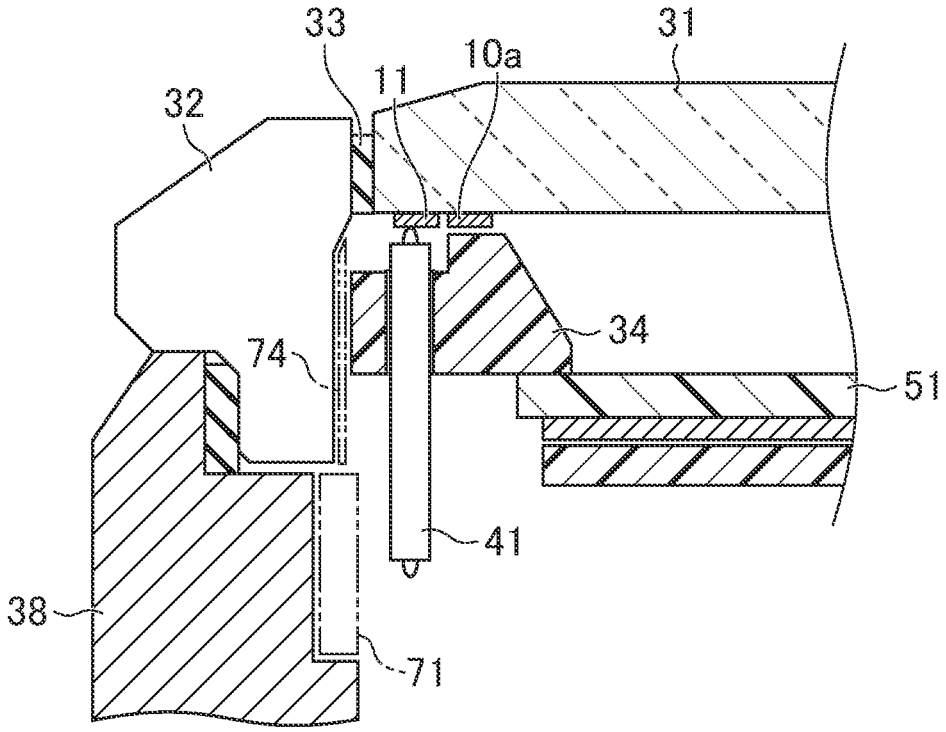
FIG. 10 is a partial sectional view illustrating another example of the satellite radio-controlled wristwatch.

FIG. 10 is a partial sectional view illustrating another example of the satellite radio-controlled wristwatch 1, and corresponds to FIG. 5. In the example of FIG. 10, the feeder electrode 11 is disposed closer to the circumference side than the antennas 10*a* and 10*b*, although the feeder electrode 11 may be disposed next to the antennas 10*a* and 10*b*. In this case, the bezel 32 includes a notch 74 at a part opposing to the conductive pin 41, and the body 38 includes a notch 71 at a part opposing to the conductive pin 41. The notch 74 serves to prevent the conductive pin 41 disposed closer to the circumference side than the example of FIG. 5 and a member (e.g., dial ring 34) to fix the conductive pin 41 from interfering with the bezel 32. In a case where the body 38 is metal, some distance is put between the body 38 and the conductive pin 41 by the notch 74, thereby preventing the sensitivity from being lowered due to the effects of the metal. The distance between the body 38 and the conductive pin 41 may be equal to or longer than the radius of the conductive pin 41. This can prevent the reception sensitivity from being lowered. In the example of FIG. 10, the dial ring 34, which is a dielectric, is disposed away from the watch glass 31 at a part opposing to the antennas 10*a* and 10*b* than a part opposing to the feeder electrode 11.

Here, unlike the example of FIG. 7, the upper surface of the watch glass 31 may be curved at least in the circumference at the cross section through the center of the satellite radio-controlled wristwatch 1 so as to make the antennas 10*a* and 10*b* less obvious.

Figure 11:
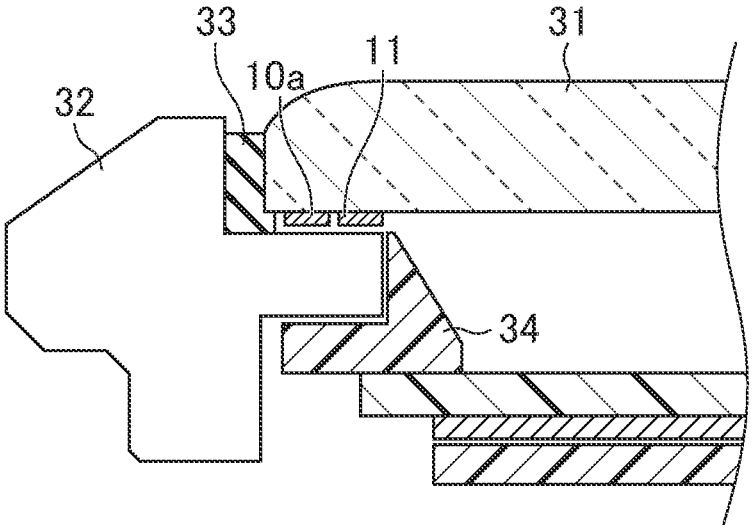
FIG. 11 is a partial sectional view illustrating another example of the satellite radio-controlled wristwatch.

FIG. 11 is a partial sectional view illustrating another example of the satellite radio-controlled wristwatch 1, and corresponds to FIG. 7. In FIG. 11, unlike the example of FIG. 7, the side wall and the planar area of the watch glass 31 are connected to each other by a curved surface where the direction of the inclination (normal line) is successively changed. The curved surface is disposed in the same area as the inclined area of FIG. 7 in a plan view. In the example of FIG. 11 as well, the antennas 10*a* and 10*b* and the feeder electrode 11 can be made less visible.

Figure 12:
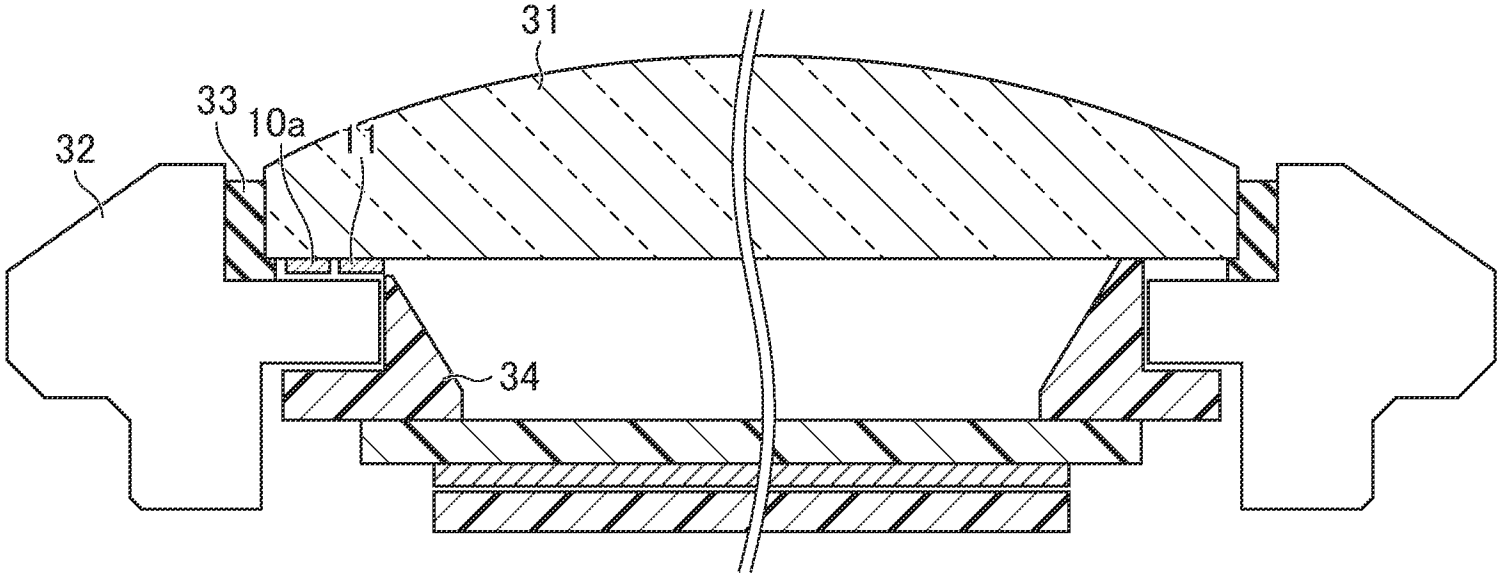
FIG. 12 is a partial sectional view illustrating another example of the satellite radio-controlled wristwatch.
Figure 13:
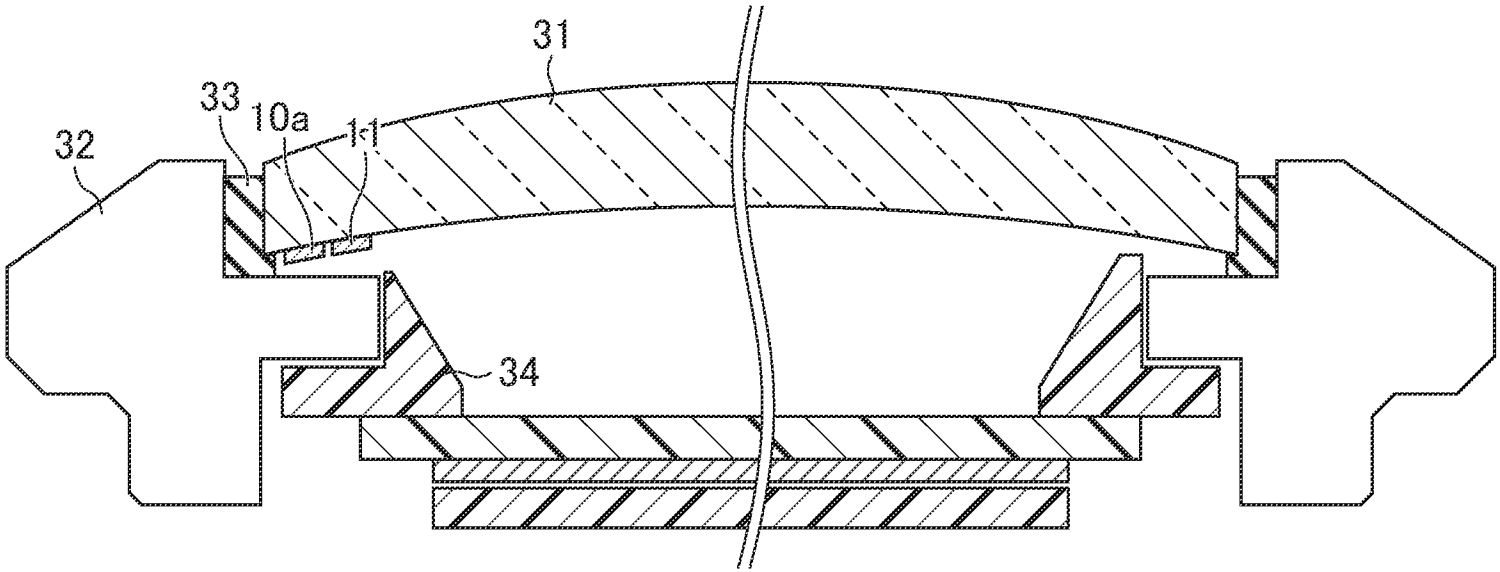
FIG. 13 is a partial sectional view illustrating another example of the satellite radio-controlled wristwatch.

FIG. 12 is a partial sectional view illustrating another example of the satellite radio-controlled wristwatch 1, and corresponds to FIG. 7. In FIG. 12, unlike the example of FIG. 7, the entire upper surface of the watch glass 31 is curved, and the circumference of the upper surface of the watch glass 31 is lower than the center of the upper surface of the watch glass 31. FIG. 13 is a partial sectional view illustrating another example of the satellite radio-controlled wristwatch 1, and corresponds to FIG. 12. In the example of FIG. 13, unlike the example of FIG. 12, the entire bottom surface of the watch glass 31 is also curved, and the circumference of the bottom surface of the watch glass 31 is lower than the center of the bottom surface of the watch glass 31. In the examples of FIGS. 12 and 13 as well, the antennas 10*a* and 10*b* and the feeder electrode 11 can be made less visible.

Here, a hidden area may be provided on the watch glass 31 by printing or processing surface treatment so as to make the antennas 10*a* and 10*b* and the feeder electrode 11 less obvious.

Figure 14:
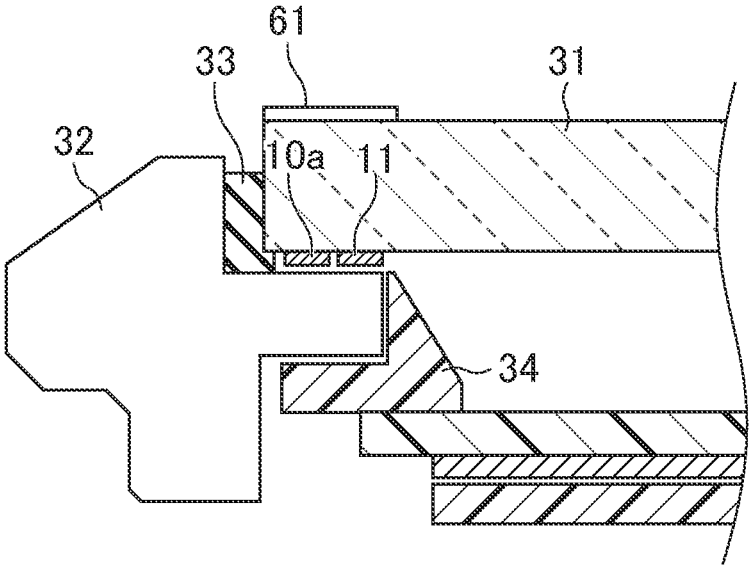
FIG. 14 is a partial sectional view illustrating another example of the satellite radio-controlled wristwatch.

FIG. 14 is a partial sectional view illustrating another example of the satellite radio-controlled wristwatch 1, and corresponds to FIG. 7. In FIG. 14, unlike the example of FIG. 7, the planar area covers the antennas 10*a* and 10*b* and the feeder electrode 11. The planar area has a normal line extending upward in the upper surface of the watch glass 31. Alternatively, a hiding area 61 formed by printing is provided in the circumference of the upper surface of the watch glass 31. The hiding area 61 covers the antennas 10*a* and 10*b* and the feeder electrode 11. The hiding area 61 may be formed by processing the surface of the watch glass 31 to increase the reflectance.

Figure 15:
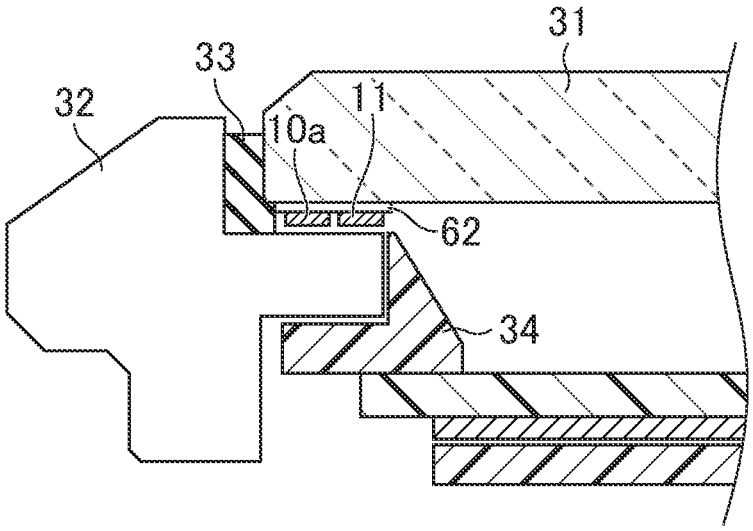
FIG. 15 is a partial sectional view illustrating another example of the satellite radio-controlled wristwatch.

FIG. 15 is a partial sectional view illustrating another example of the satellite radio-controlled wristwatch 1, and corresponds to FIG. 14. In the example of FIG. 15, unlike the example of FIG. 14, a hiding area 62 is disposed so as to be in contact with the bottom surface of the watch glass 31, and covers the antennas 10*a* and 10*b* and the feeder electrode 11. More specifically, the hiding area 62 is formed by printing on the circumference of the bottom surface of the watch glass 31, and the antennas 10*a* and 10*b* and the feeder electrode 11 are adhered to the bottom surface of the hiding area 62. In the example of FIG. 15 as well, the hiding area 62 may be formed by processing the surface of the watch glass 31 so as to increase the reflectance. In this regard, printing indicative of information, such as cities, time-zone differences, memories, and receptions, or decorative printing may be provided between the hiding area 62 and the watch glass 31. The colors of the hiding areas 61 and 62 may be the same as at least some of the colors of the bezel 32, the dial ring 34, the dial plate 51, and the packing 33. This makes the hiding areas 61 and 62 less obvious.

Figure 16:
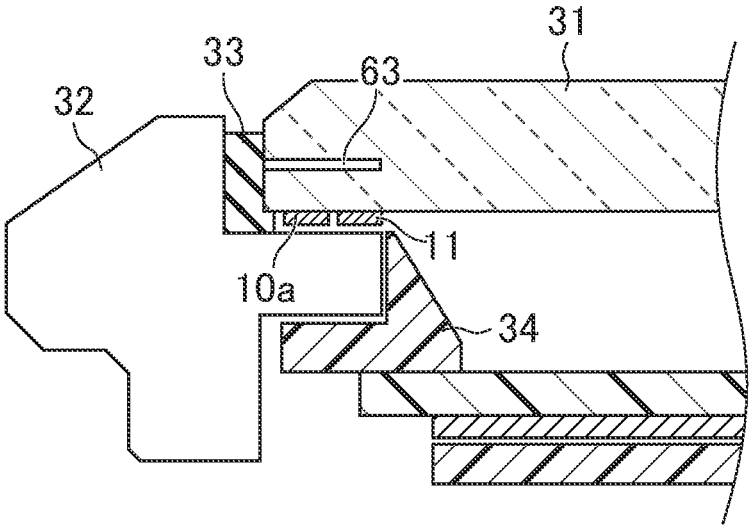
FIG. 16 is a partial sectional view illustrating another example of the satellite radio-controlled wristwatch.

FIG. 16 is a partial sectional view illustrating another example of the satellite radio-controlled wristwatch 1, and corresponds to FIG. 7. In FIG. 16, unlike the example of FIG. 7, the planar area having a normal line extending upward in the upper surface of the watch glass 31 overlaps the antennas 10*a* and 10*b* and the feeder electrode 11 in a plan view. Alternatively, a trench is provided in the circumference (side wall) of the watch glass 31 between the upper surface and the bottom surface of the watch glass 31 so as to overlap the antennas 10*a* and 10*b* and the feeder electrode 11 in a plan view, and a member is inserted in the trench. The member forms a hiding area 63. The hiding area 63 covers the antennas 10*a* and 10*b* and the feeder electrode 11.

Figure 17:
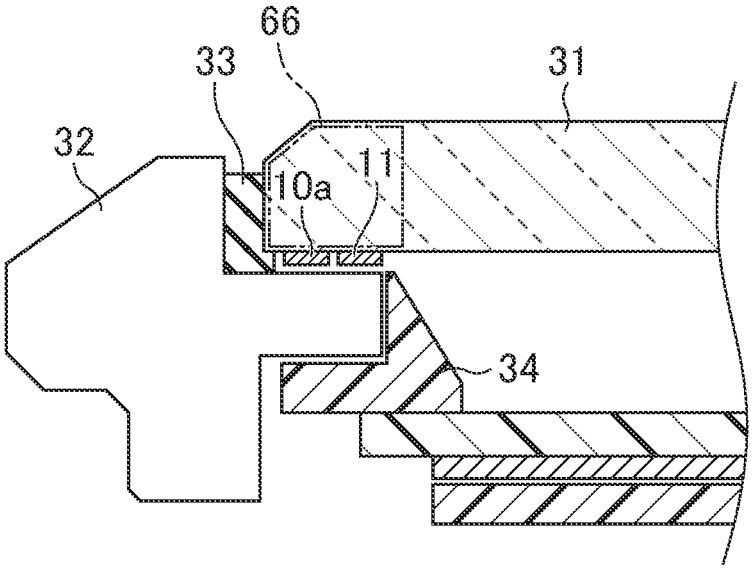
FIG. 17 is a partial sectional view illustrating another example of the satellite radio-controlled wristwatch.

FIG. 17 is a partial sectional view illustrating another example of the satellite radio-controlled wristwatch 1, and corresponds to FIG. 7. In the example of FIG. 17, the watch glass 31 includes a colored part 66 having a deeper color and greater reflectance or lower transmittance than other parts. The colored part 66 is the circumference part of the watch glass 31, and covers the antennas 10*a* and 10*b* and the feeder electrode 11.

In the examples of FIGS. 14 to 17, the antennas 10*a* and 10*b* and the feeder electrode 11 are covered by the hiding areas so as not to be seen from the outside. In order to secure a light-receiving area of the solar cell 53, the hiding areas are preferably disposed outside the solar cell 53 in a plan view.

Figure 18:
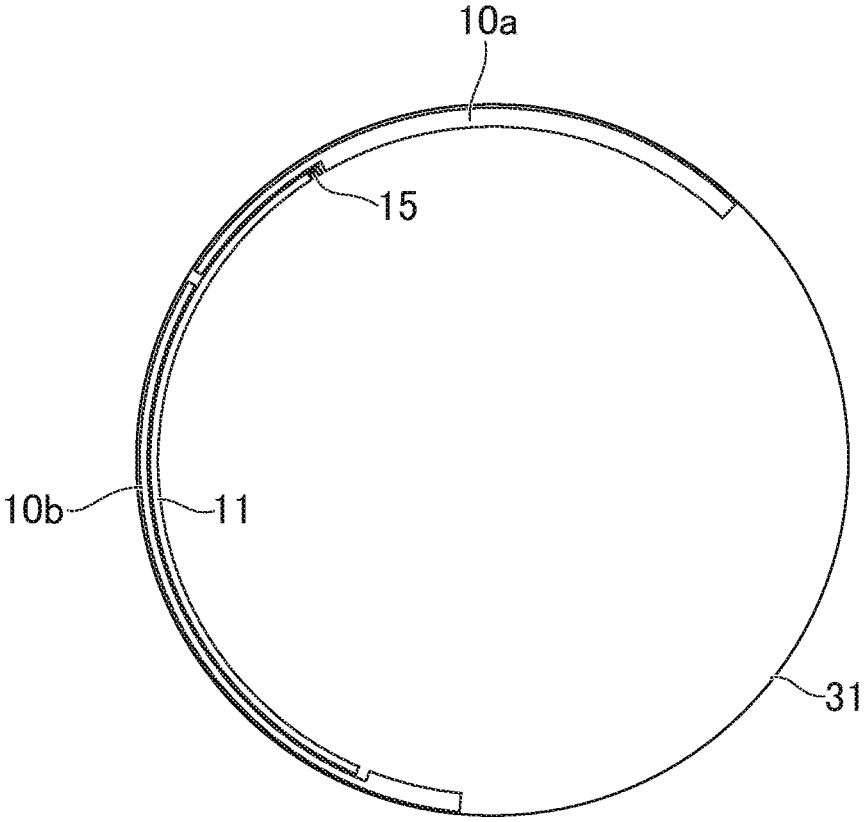
FIG. 18 is a plan view of another example of placement of antennas and a feeder electrode.

In the example of FIG. 11, the antennas 10*a* and 10*b* respectively have a constant width, although the width may vary depending on positions. FIG. 18 is a plan view of another example of placement of the antennas 10*a* and 10*b* and the feeder electrode 11. In the example of FIG. 18, unlike the example of FIG. 11, a width of each of the antennas 10*a* and 10*b* is narrower at a first part where each of the antennas 10*a* and 10*b* is adjacent to the feeder electrode 11 than at a second part where each of the antennas 10*a* and 10*b* is not adjacent to the feeder electrode 11. This reduces the width of the area in which the antennas 10*a* and 10*b* and the feeder electrode 11 are placed viewed from the surface of the watch glass 31. This can reduce the deterioration of the sensitivity of the antennas 10*a* and 10*b* due to the wiring resistance, for example, and reduce the hiding areas.

Figure 19:
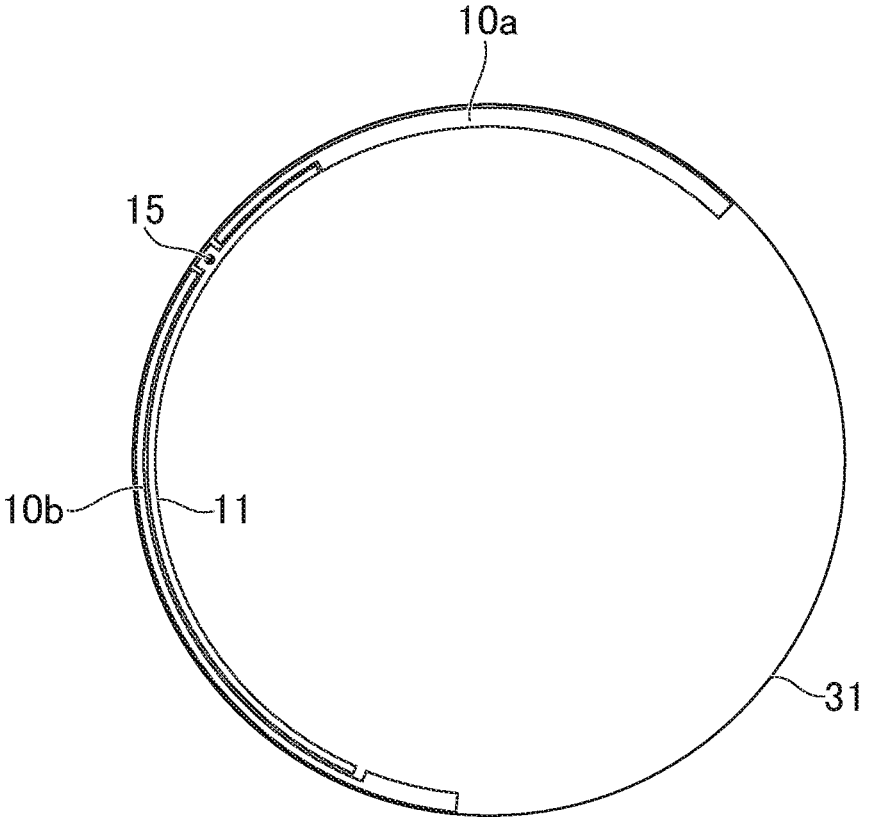
FIG. 19 is a plan view of another example of placement of the antennas and the feeder electrode.

FIG. 19 is a plan view of another example of placement of the antennas 10*a* and 10*b* and the feeder electrode 11. In the example of FIG. 19, the antennas 10*a* and 10*b* are not adjacent to each other, and the feeder electrode 11 includes a first area adjacent to the antenna 10*a*, a second area adjacent to the antenna 10*b*, and a third area connecting the first area to the second area. The third area is not adjacent to the antennas 10*a* and 10*b* on either of the circumference sides and the inner sides, and disposed between the antenna 10*a* and the antenna 10*b*. The connection area 15 is provided in the third area. Compared to the example of FIG. 18, the feeder electrode 11 is wider at the position of the connection area 15 due to the third area, and positions of the conductive pin 41 and the connection area 15 can be readily adjusted even the widths of the antennas 10*a* and 10*b* are narrowed. If the connection area is increased without using the configuration of FIG. 19, the connection area protrudes toward the center of the watch glass 31. Consequently, the hiding area needs to be widened, resulting in a strange outer design of the satellite radio-controlled wristwatch 1. In other words, the feeder electrode 11 is disposed between the antenna 10*a* and the antenna 10*b*, and thus the width of the hiding area can be narrowed.

Figure 20:
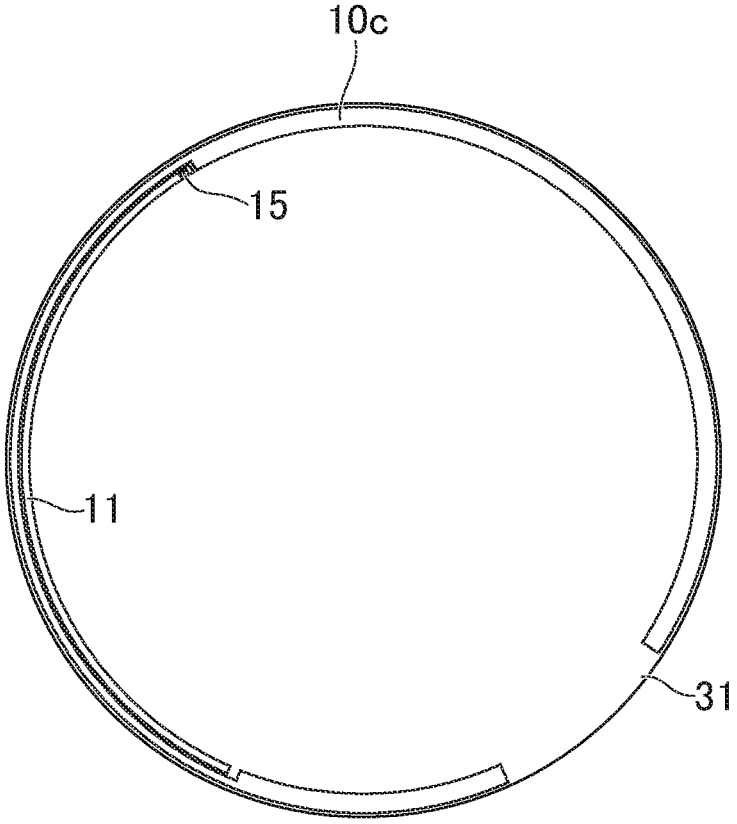
FIG. 20 is a plan view of another example of placement of an antenna and the feeder electrode.

The present invention can be applied to antennas other than a dipole antenna. FIG. 20 is a plan view of another example of placement of the antennas 10*a* and 10*b* and the feeder electrode 11. In the example of FIG. 20, an antenna 10*c* is a type of loop antennas, and has a shape of integrating the antennas 10*a* and 10*b* in FIG. 18 and extending their edges. The antenna 10*c* is an annular antenna with a portion cut out and thus C-shaped. Such an antenna 10*c* can also increase reception sensitivity of radio waves by disposing the feeder electrode 11 on the back of the watch glass 31.

In the examples described above, the entire bezel 32 is formed of ceramics, although the bezel 32 may include a part formed of a dielectric material, such as ceramics, and a part formed of metal, and these parts may be joined.

Figure 21:
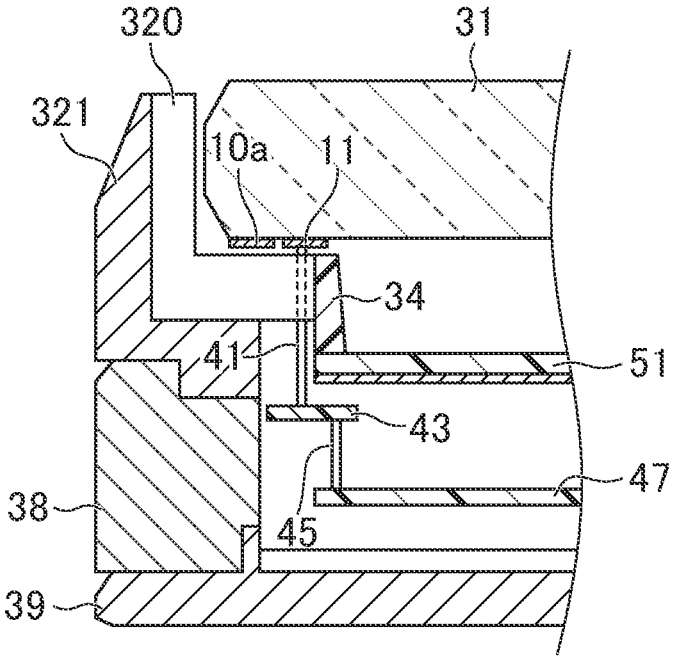
FIG. 21 is a partial sectional view illustrating another example of the satellite radio-controlled wristwatch.

FIG. 21 is a schematic partial sectional view illustrating another example of the satellite radio-controlled wristwatch 1, and shows a cross section corresponding to FIG. 7. In the example of FIG. 21, unlike the example described in FIG. 7, the bezel 32 includes a dielectric part 320 formed of a dielectric material, such as ceramics, and a metal part 321 formed of metal. The dielectric part 320 is formed in a shape of a ring having a rectangular cross-section with an upper and inner rectangular area cut out. The watch glass 31 is fixed into the cut-out area. The dielectric part 320 includes an annular first part having an upper surface and a bottom surface in a plan view, and a second part extending upward from the outer circumference of the first part. The first part overlaps the antennas 10*a* and 10*b* and the feeder electrode 11 in a plan view. The second part is laterally adjacent to the antennas 10*a* and 10*b*. When viewed vertically, the antennas 10*a* and 10*b* and the feeder electrode 11 are disposed between the upper end and the lower end of the second part. The metal part 321 is fitted into the body 38 and includes a lateral part, which supports the first part of the dielectric part 320, and a longitudinal part, which surrounds the side wall (outer side wall) of the dielectric part 320. The dial ring 34 is disposed so as to be in contact with the inner side wall of the first part of the dielectric part 320.

The bezel 32 is partially formed of a dielectric, such as ceramics, at a part close to the antennas 10*a* and 10*b*. This serves to provide a highly sensitive and thin satellite radio-controlled wristwatch 1. In addition, the bezel 32 is partially formed of metal at the metal part 321, which serves to increase tolerance for impact. In particular, it is possible to allow two characteristics of high sensitivity and tolerance for impact to coexist.

Figure 22:
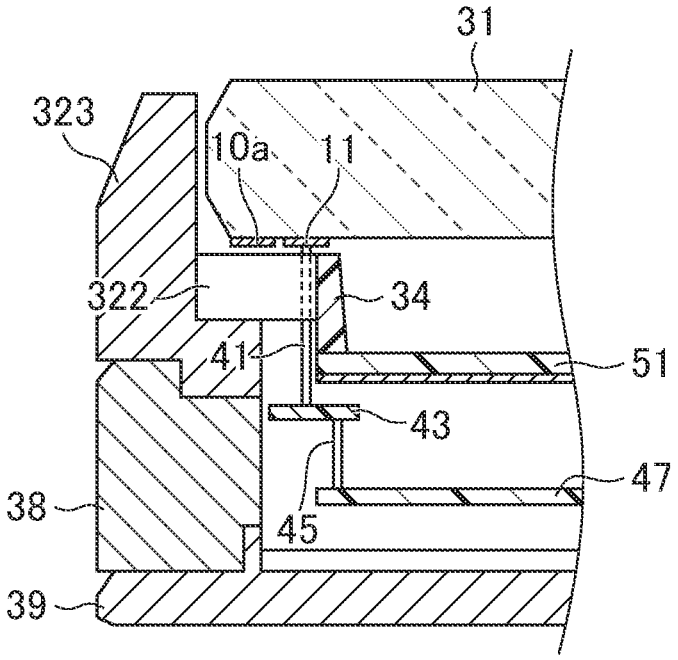
FIG. 22 is a partial sectional view illustrating another example of the satellite radio-controlled wristwatch.

FIG. 22 is a schematic partial sectional view of another example of the satellite radio-controlled wristwatch 1 and corresponds to FIG. 21. In the example of FIG. 22, unlike the example of FIG. 21, a dielectric part 322 included in the bezel 32 does not have a part corresponding to the second part, and the dielectric part 322 is not laterally adjacent to the antennas 10*a* and 10*b*. The metal part 323 included in the bezel 32 is fitted into the body 38 and includes a lateral part, which supports the first part of the dielectric part 322, and a longitudinal part, which is adjacent to the side wall of the dielectric part 322 and the side wall of the watch glass 31 and constitutes the outer side wall of the bezel 32. In the example of FIG. 22 as well, it is possible to increase the tolerance for impact of the bezel 32, and provide a texture of metal.

Figure 23:
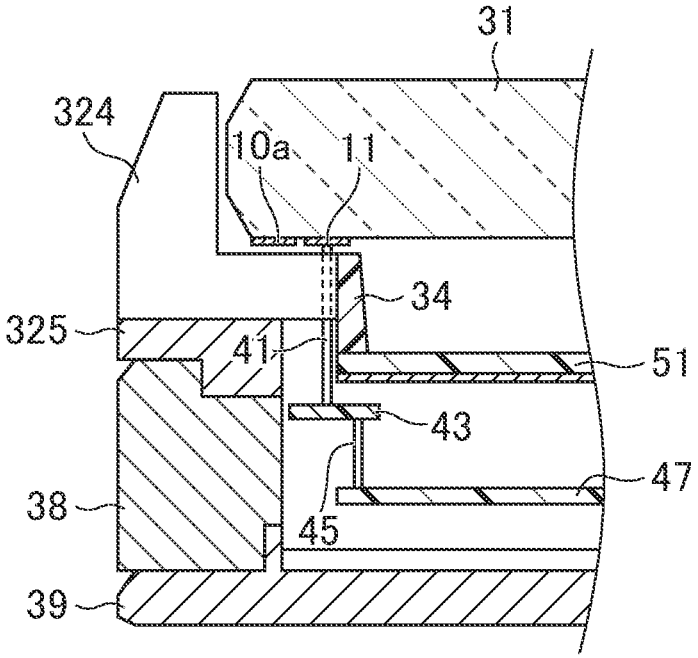
FIG. 23 is a partial sectional view illustrating another example of the satellite radio-controlled wristwatch.

FIG. 23 is a schematic partial sectional view illustrating another example of the satellite radio-controlled wristwatch 1 and corresponds to FIG. 21. In the example of FIG. 23, the dielectric part 324 included in the bezel 32 includes an annular first part having an upper surface and a bottom surface in a plan view, and a second part extending upward from the outer circumference of the first part. In the example of FIG. 23, unlike the example of FIG. 21, the dielectric part 324 also constitutes the side wall of the bezel 32 on the outer circumference side. A metal part 325 included in the bezel 32 is joined to the bottom surface of the dielectric part 324 and fitted into the body 38, and does not surround the side wall of the dielectric part 324. This can increase reception sensitivity.

Figure 24:
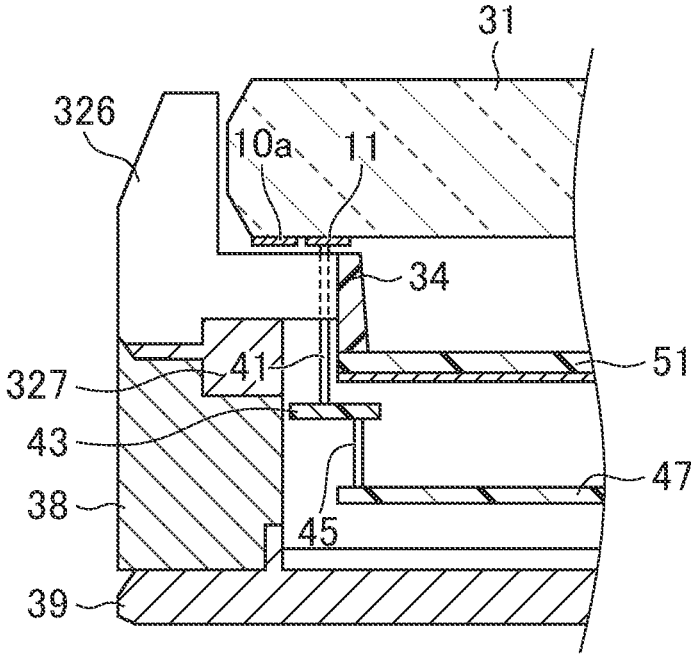
FIG. 24 is a partial sectional view illustrating another example of the satellite radio-controlled wristwatch.

FIG. 24 is a schematic partial sectional view illustrating another example of the satellite radio-controlled wristwatch 1, and corresponds to FIG. 23. In the example of FIG. 24, similarly to the example of FIG. 23, a dielectric part 326 included in the bezel 32 also forms the side wall of the bezel 32 on the outer circumference side. In the example of FIG.

24, unlike the example of FIG. 23, the dielectric part 326 includes a third part extending downward from the edge of the outer circumference of the first part, in addition to the annular first part having the upper surface and the bottom surface in a plan view and the second part extending upward from the edge of the outer circumference of the first part. Further, the lower end of the side wall of the third part is in contact with the upper end of the side wall of the outer circumference of the body 38, and a metal part 327 is not exposed on the side surface of the bezel 32. The metal part 327 is connected so as to be in contact with the bottom surface of the second part and the lower end of the side surface and the bottom surface of the third part, and fitted into the body 38. In the example of FIG. 24, the metal part 327 is not exposed, and thus a connected part of the metal part 327 and the dielectric part 326 can be made less visible.

Figure 25:
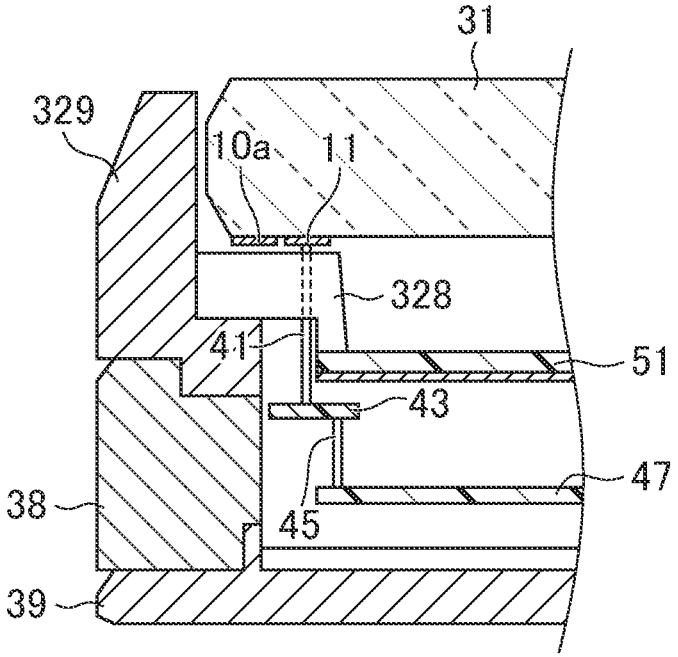
FIG. 25 is a partial sectional view illustrating another example of the satellite radio-controlled wristwatch.

FIG. 25 is a schematic partial sectional view of another example of the satellite radio-controlled wristwatch 1, and corresponds to FIG. 22. In the example of FIG. 25, a dielectric part 328 included in the bezel 32 is integrally formed so as to include a part corresponding to the dial ring 34 in FIG. 22. A metal part 329 is fitted into the body 38 and includes a lateral part, which supports the first part of the dielectric part 322, and a longitudinal part, which is adjacent to the side wall of the dielectric part 328 and the side wall of the watch glass 31 and constitutes the outer side wall of the bezel 32.

In the examples of FIGS. 22 and 25, a dielectric is not disposed in the side surfaces of the antennas 10*a* and 10*b*. In this configuration, a packing formed of a high dielectric is preferably disposed so as to achieve a larger wavelength shortening effect. In the examples other than the example of FIG. 25, the bezel 32 and the dial ring 34 may be integrally formed.

Figure 27:
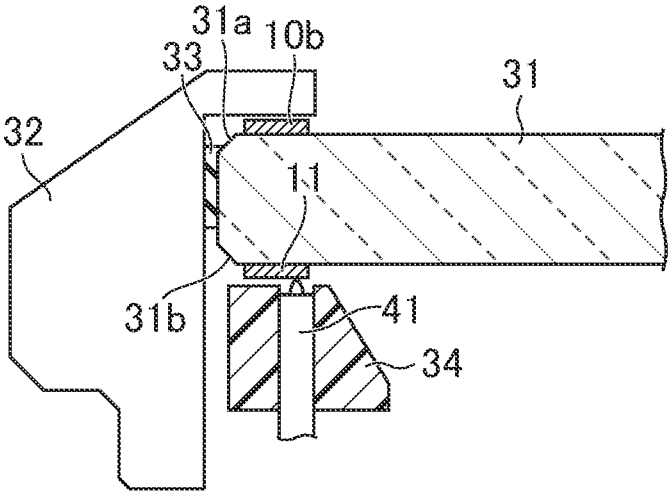
FIG. 27 is a partial sectional view illustrating another example of the satellite radio-controlled wristwatch.

The antennas 10*a* and 10*b* may be disposed on the surface of the circumference of the watch glass 31. FIG. 27 is a partial sectional view illustrating another example of the satellite radio-controlled wristwatch 1. In the example of FIG. 27, the antennas 10*a* and 10*b* are disposed on the surface of the circumference of the watch glass 31, and are adjacent to each other via the feeder electrode 11 and the watch glass 31 disposed on the back of the circumference of the watch glass 31. The watch glass 31 includes an inclined surface 31*a* connecting the side surface and the top surface of the watch glass 31, and an inclined surface 31*b* connecting the side surface and the bottom surface of the watch glass 31. The antennas 10*a* and 10*b* extend along the circumference of the watch glass 31 in a plan view. In the example of FIG. 27, the antennas 10*a* and 10*b* extend along the circumference of the top surface of the watch glass 31, and are adjacent to the boundary between the top surface and the inclined surface 31*a*. The feeder electrode 11 extends along the circumference of the back surface of the watch glass 31, and is adjacent to the boundary between the back surface and the inclined surface 31*b*. The top surface of the circumference of the watch glass 31 includes a projection 32*b* of the bezel 32. The projection 32*b* of the bezel 32 is annular in a plan view, and covers the antennas 10*a* and 10*b*. The bezel 32 is formed of a dielectric material, such as ceramics.

In the example of FIG. 27, compared with the example e.g., FIG. 5, the antennas 10*a* and 10*b* are disposed apart from a metal member, such as a movement, and thus the sensitivity can be increased. The bezel 32 is formed of a dielectric, and can shorten the wavelength of radio waves received by the antennas 10*a* and 10*b*. The bezel 32 partially overlaps the antennas 10*a* and 10*b* in a plan view, which makes the antennas 10*a* and 10*b* less visible. This eliminates the need of providing a blinding layer, such as printing, and does not damage the appearance of the watch. Further, a part of the bezel 32 overlapping the antennas 10*a* and 10*b* in a plan view may have watch display information, such as indexes of city names and time measurement (e.g., telemeter, tachymeter, chronometer) that are printed or marked. This makes indexes visible.

In the example of FIG. 27, the antennas 10*a* and 10*b* are disposed on the circumference of the surface, but may be disposed on the inclined surface 31*a*. The feeder electrode 11 may be disposed on the inclined surface 31*b*. A body integrally formed with the bezel 32 may be provided instead of the bezel 32. The bezel 32 may be formed of resin, such as plastics, which is a dielectric, although resin has less wavelength-shortening effect than ceramics. This can simplify the process of manufacturing a bezel and reduce cost of parts.

Figure 28:
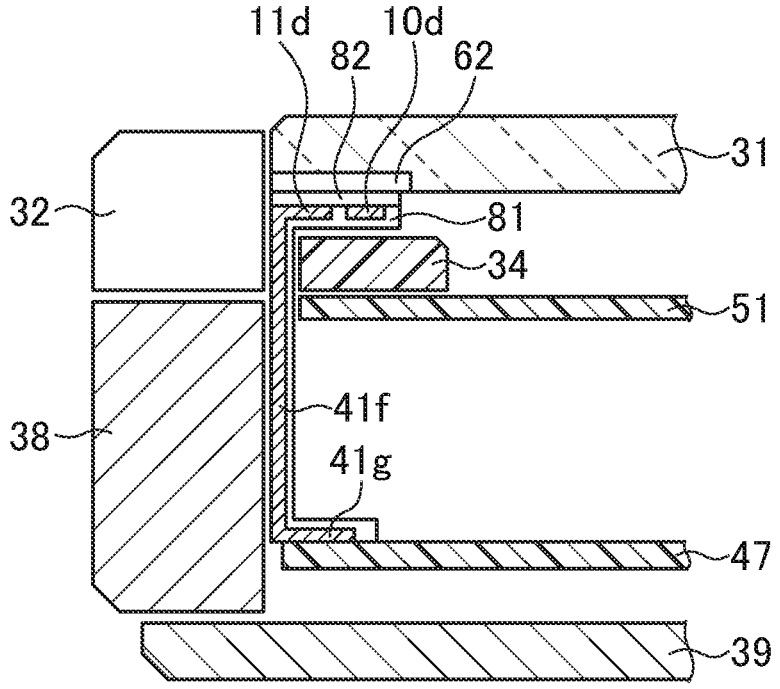
FIG. 28 is a partial sectional view illustrating another example of the satellite radio-controlled wristwatch.
Figure 29:
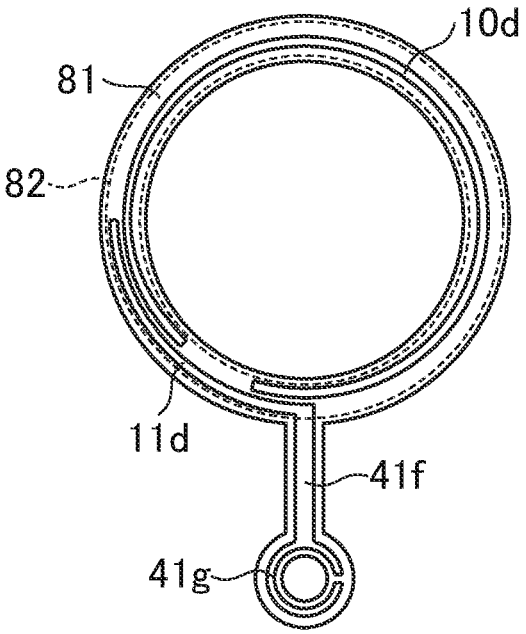
FIG. 29 is a plan view of an example of an FPC substrate.

Antennas and wiring may be provided using a flexible printed circuit substrate (FPC substrate). FIG. 28 is a schematic partial sectional view illustrating another example of the satellite radio-controlled wristwatch 1. FIG. 29 is a plan view of an example of an FPC substrate 81. FIG. 28 is a sectional view corresponding to FIGS. 5 and 21, and a schematic diagram in which small parts, such as a packing, are omitted. FIG. 29 is a plan view of the FPC substrate 81 in an unfolded state. In the examples of FIGS. 28 and 29, unlike the examples described above, an antenna 10*d* and a feeder electrode 11*d* are formed on the FPC substrate 81.

More specifically, the FPC substrate 81 in its unfolded state has an annular main part and a connection part extending outwardly from the annular part. The connection part is connected to an annular terminal area or an arc-shaped terminal area, which has an annular shape with a portion cut out, at the outside edge.

The FPC substrate 81 shown in FIG. 29 includes an adhesive layer 82 on the back side of the main part, and the main part is adhered to the lower side of the watch glass 31 by the adhesive layer 82. In the example of FIG. 28, the hiding area 62 is provided between the adhesive layer 82 and the watch glass 31. FIG. 29 corresponds to the main part of the FPC substrate 81 viewed from the bottom. The connection part is bent at the area connecting to the main part, and extends downward along the inner circumferential surface of the bezel 32 and the body 38. The terminal area is fixed on the circuit substrate 47.

The main part of the FPC substrate 81 includes the antenna 10*d* having an annular shape with a portion cut out and the feeder electrode 11*d* adjacent to radially outward of the antenna 10*d*. It can be said that the feeder electrode 11*d* is adjacent to the antenna 10*d* in a direction perpendicular to the thickness direction of the antenna 10*d*. The feeder electrode 11*d* is an arc-shaped electrode. In the example of FIG. 29, parts of the antenna 10*d* close to its ends are adjacent to the feeder electrode 11*d*, and a part around the center of the arc is not adjacent to the feeder electrode 11*d*. In the following, the cut-out portion of the antenna 10*d* is described as a vacant part. The antenna 10*d* may be annular in shape.

The main part of the FPC substrate 81 includes a connecting wire 41*f*. One end of the feeder electrode 11*d* is connected to the connecting wire 41*f*. The connecting wire 41*f* has a linear part extending to the terminal area, and the linear part is connected to an arc-shaped terminal part 41*g* having an annular shape with a portion cut out in the terminal area. The terminal part 41*g* is electrically connected to wires on the circuit substrate 47.

In the example of FIG. 5, when attaching the watch glass 31, the feeder electrode 11 and the conductive pin 41 need to be precisely positioned. While in the example of FIG. 28 and FIG. 29, the antenna 10*d*, the feeder electrode 11*d*, and the connecting wire 41*f* are integrally formed as an FPC substrate 81, in which a slight misalignment is allowed. In addition, routing of the connecting wire 41*f* in the case can be easily made. These configurations can facilitate attachment of the watch glass 31 and the parts in the case, which serves to reduce manufacturing cost. The feeder electrode 11*d* does not require an area to connect to the conductive pin 41, and thus the feeder electrode 11*d* can be thinned. Further, the connection part of the feeder electrode 11*d* and the connecting wire 41*f* is less restrictive, which increases design flexibility of a balun circuit, for example. Further, a balun circuit and a matching circuit can be formed on the FPC substrate 81. This eliminates the need for additionally providing a substrate for mounting circuits, thereby saving space.

The antenna 10*d* may not necessarily be disposed on the FPC substrate 81. For example, the antenna 10*d* may be formed on the bottom surface of the circumference of the watch glass 31 by evaporation, for example. In this case, the feeder electrode 11*d* and the connecting wire 41*f* may be formed on the FPC substrate 81, and the FPC substrate 81 may be adhered to the bottom surface of the watch glass 31 so that the feeder electrode 11*d* is adjacent to the antenna 10*d* in a direction perpendicular (different) to the thickness direction of the antenna 10*d*. The FPC substrate 81 may comprise multiple layers. The first layer may include the antenna 10*d*, and the feeder electrode 11*d* is disposed on the second layer so as to overlap the antenna 10*d* in a plan view. This can maintain a constant distance between the antenna 10*d* and feeder electrode 11*d* to reduce variations in antenna characteristics, and also narrow the width of the FPC substrate 81.

Figure 30:
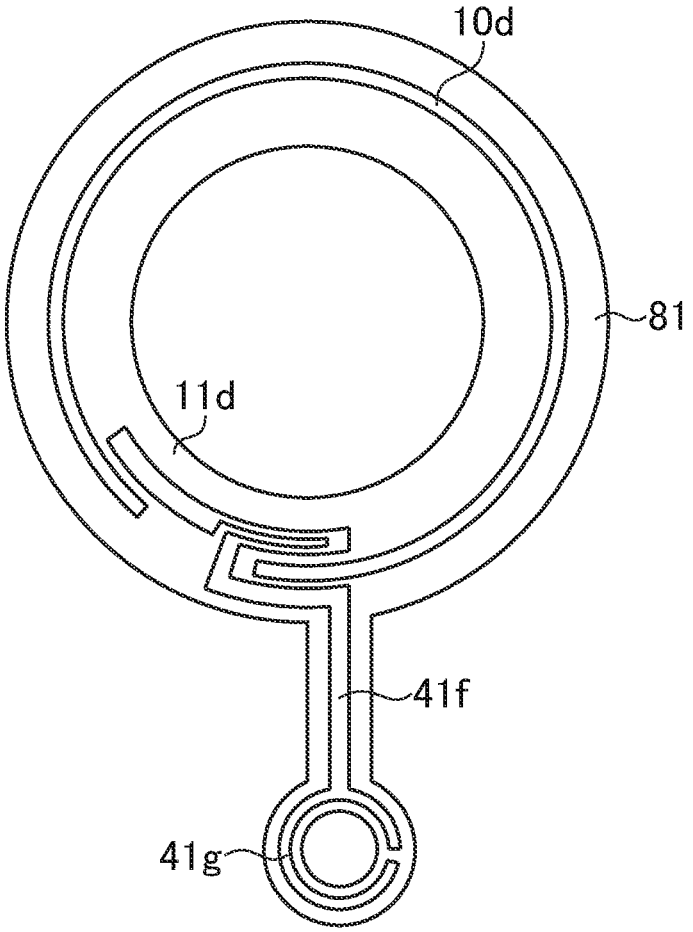
FIG. 30 is a plan view of another example of the FPC substrate.

FIG. 30 is a plan view of another example of the FPC substrate 81. In FIG. 30, the adhesive layer 82 is omitted. In the example of FIG. 30, unlike the example of FIG. 29, the feeder electrode 11*d* is adjacent to the radially inner portion of the antenna 10*d*. The feeder electrode 11*d* includes a first arc-shaped part and a second arc-shaped part. The first arc-shaped part extends from one end of the antenna 10*d* to the other end. The second arc-shaped part is folded back from the one end of the first arc-shaped part, opposed to the antenna 10*d*, and extending to an area adjacent to the vacant part. In order to maintain a constant distance between the feeder electrode 11*d* and the antenna 10*d*, the second arc-shaped part and a part of the first arc-shaped part where the first arc-shaped part is adjacent to the second arc-shaped part are thinner than the other part of the first arc-shaped part. With this configuration, the impedance between the antenna 10*d* and a circuit connected to the antenna 10*d* is matched.

The ends of the feeder electrode 11*d* are electrically connected to the connecting wire 41*f*. The connecting wire 41*f* includes, for example, an arc-shaped part slightly extending along radially outward of the antenna 10*d* and a linear part that is bent ahead of the arc-shaped part, extends toward the terminal area, and is connected to the terminal part 41*g*. Needless to say, the terminal part 41*g* may be disposed radially inward of the main part with the FPC substrate 81 unfolded. In this case, the connecting wire 41*f* is electrically connected to the end of the feeder electrode 11*d* adjacent to the radially inner portion of the antenna 10*d*, extends radially inward, and is connected to the terminal part 41*g*. The FPC substrate 81 may have the linear part extending radially inward in which the connecting wire 41*f* is disposed. This serves to form the FPC substrate 81 and the connecting wire 41*f* in simple shapes.

In the example of FIG. 30, compared with the example of FIG. 29, the antenna 10*d* can be positioned more radially outward. As such, the antenna 10*d* can be made longer, and reception characteristics can be readily improved.

Figure 31:
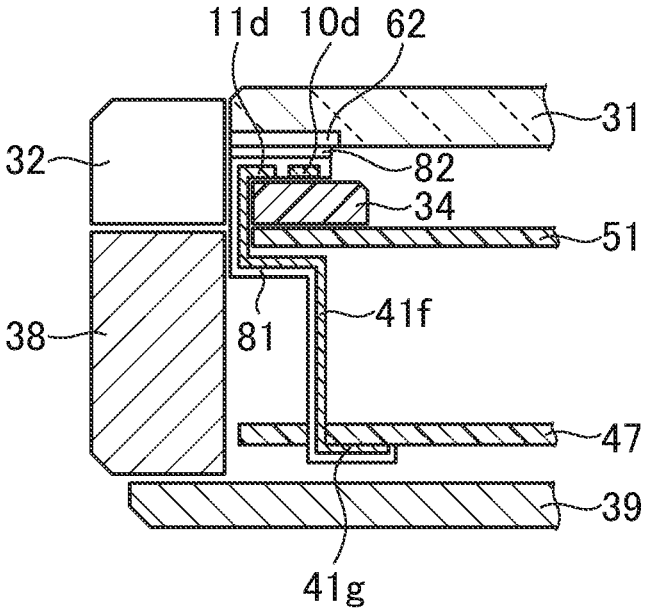
FIG. 31 is a partial sectional view illustrating another example of the satellite radio-controlled wristwatch.

FIG. 31 is a partial sectional view illustrating another example of the satellite radio-controlled wristwatch 1, and corresponds to FIG. 28. In the example of FIG. 31, the connection part of the FPC substrate 81 includes a first part extending downward from the vicinity of the watch glass 31 along the inner circumferential surface of the bezel 32, a second part extending radially inward along the dial plate 51 after the bend, and a third part extending further downward. The third part penetrates the circuit substrate 47, and the terminal area is in contact with the wiring on the circuit substrate 47 below the circuit substrate 47.

In the example of FIG. 31, the effects of the body 38 made of metal on the connecting wire 41*f* can be reduced.

Figure 32:
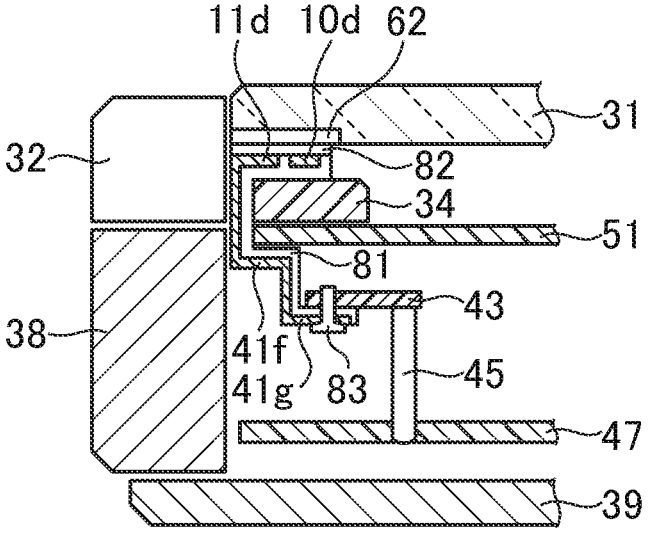
FIG. 32 is a partial sectional view illustrating another example of the satellite radio-controlled wristwatch.

FIG. 32 is a partial sectional view illustrating another example of the satellite radio-controlled wristwatch 1. In FIG. 32, unlike the example of FIG. 31, the terminal area of the FPC substrate 81 is attached to the wiring substrate 43 that is disposed on the upper side of the circuit substrate 47. The third part of the FPC substrate 81 extends downward on the radially outside of the wiring substrate 43, and is connected to the terminal area below the wiring substrate 43. The terminal area of the FPC substrate 81 is attached to the wiring substrate 43 with a screw 83. The balun circuit 21 (not shown) is disposed on the wiring substrate 43, and the connecting wire 41*f* is electrically connected to the balun circuit 21. Similarly to the example of FIG. 5, the balun circuit 21 is electrically connected to the wiring on the circuit substrate 47 via the coaxial pin 45. In the example of FIG. 32, similarly to the example of FIG. 5, the effects of the metal of the body 38 can be minimized.

Figure 33:
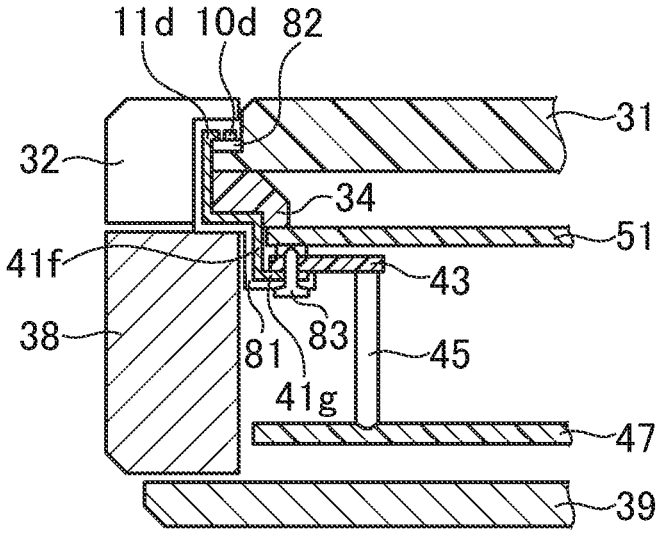
FIG. 33 is a partial sectional view illustrating another example of the satellite radio-controlled wristwatch.

FIG. 33 is a partial sectional view illustrating another example of the satellite radio-controlled wristwatch 1. In the example of FIG. 33, unlike the example of FIG. 32, the watch glass 31 includes an upper surface, a first outer circumferential surface, which is a side surface connected to the upper surface, an annular upper step surface, which is connected to the first outer circumferential surface and disposed outside of the upper surface in a plan view, a second outer circumferential surface, which is a side surface connected to the upper step surface, and a lower surface connected to the second outer circumferential surface. The main part of the FPC substrate 81 is adhered to the upper side of the upper step surface by the adhesive layer 82. The bezel 32 includes a receiving part opposing to the upper step surface, and the watch glass 31 is fitted into the bezel 32 from below.

In the example of FIG. 33, the connection part of the FPC substrate 81 includes a first part extending downward along the inner circumferential surface of the bezel 32, a fourth part extending radially inward below the dial ring 34, and a third part extending downward between the body 38 and the combination of the dial plate 51 and the wiring substrate 43. The terminal area is placed below the wiring substrate 43. The terminal area is placed below the wiring substrate 43. The terminal area is attached to the wiring substrate 43 with the screw 83. In the example of FIG. 33, the bezel 32 covers the upper side of the antenna 10*d*, thereby lessening restriction on designs due to the existence of the antenna 10*d*. In a case where the bezel 32 is made of ceramics, reception sensitivity can be readily improved by the wavelength-shortening effect of the high dielectric, for example.

Figure 34:
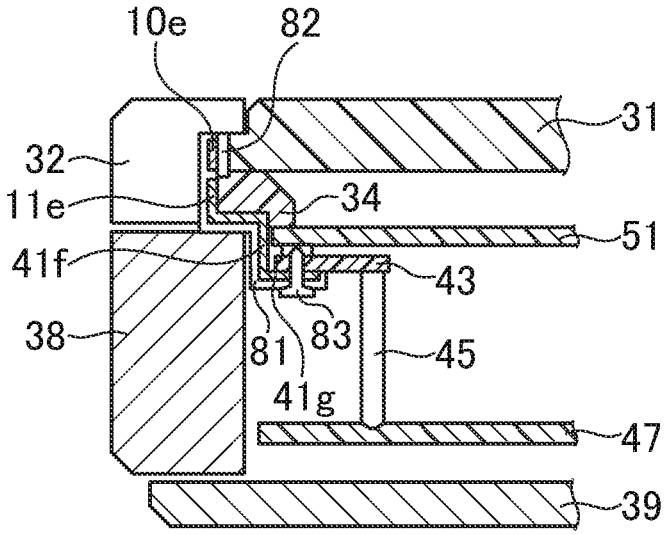
FIG. 34 is a partial sectional view illustrating another example of the satellite radio-controlled wristwatch.
Figure 35:
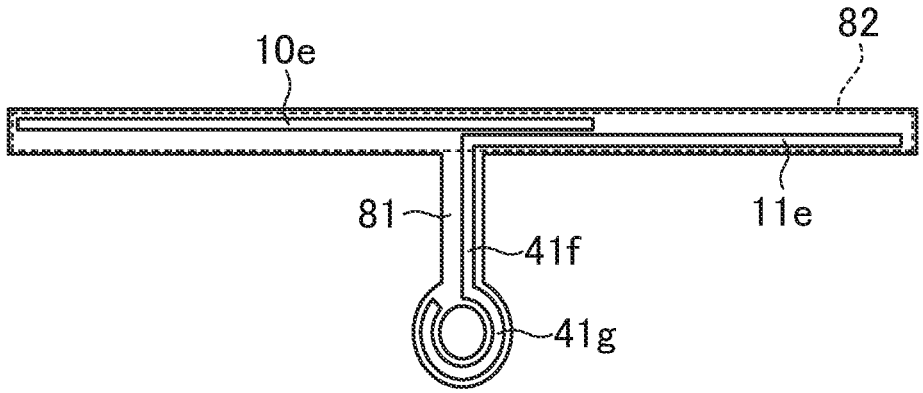
FIG. 35 is a plan view of another example of the FPC substrate.

FIG. 34 is a partial sectional view illustrating another example of the satellite radio-controlled wristwatch 1. FIG. 35 is a plan view of another example of the FPC substrate 81. FIG. 35 is a plan view of the FPC substrate 81 in FIG. 34 in an unfolded state. In the examples of FIGS. 34 and 35, unlike the example of FIG. 33, the antenna 10*e* is disposed along the outer circumferential surface (more precisely, the second outer circumferential surface) of the watch glass 31.

The FPC substrate 81 includes a main part that is linear in an unfolded state, and a connection part extending in a direction perpendicular to a direction in which the main part extends. The main part of the FPC substrate 81 is bent so as to cover the second outer circumferential surface of the watch glass 31, and adhered to the watch glass 31 by the adhesive layer 82. The watch glass 31 adhered to the FPC substrate 81 is fitted into the bezel 32 from below.

On the main part of the FPC substrate 81, the antenna 10*e* extends along the circumference of the watch glass 31, and the feeder electrode lie, which is partially adjacent to the antenna 10*e* and extends along the circumference of the watch glass 31, is provided below the antenna 10*e* (in a direction perpendicular to the thickness direction). The connecting wire 41*f* is connected to one end of the feeder electrode lie, extends in the connection part toward the terminal area, and is connected to the terminal part 41*g*.

The connection part of the FPC substrate 81 includes a first part extending downward along the inner circumferential surface of the bezel 32, a fourth part extending radially inward below the dial ring 34, and a third part extending downward between the body 38 and both of the dial plate 51 and the wiring substrate 43. The terminal area is placed below the wiring substrate 43. The terminal area is attached to the wiring substrate 43 with the screw 83.

In the examples of FIGS. 34 and 35, compared with the example of FIG. 33, a packing is easily installed to perform functions between the upper step surface of the watch glass 31 and the bezel 32, thereby improving waterproof qualities. In the examples of FIGS. 34 and 35 as well, the antenna 10*e* is not visible from the outside, thereby increasing the flexibility of design.

Figure 36:
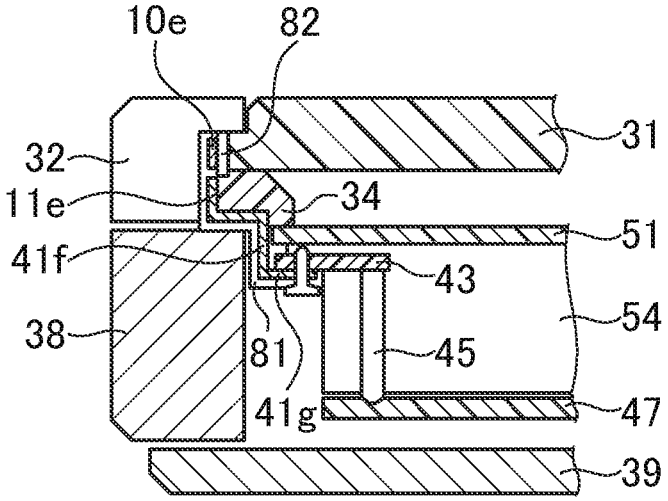
FIG. 36 is a partial sectional view illustrating another example of the satellite radio-controlled wristwatch.

FIG. 36 is a partial sectional view illustrating another example of the satellite radio-controlled wristwatch 1. In the example of FIG. 36, unlike the example of FIG. 34, the wiring substrate 43 is fixed to the main plate 54, and the screw 83 penetrates the wiring substrate 34 and is fixed to the main plate 54. In the example of FIG. 36, the terminal area of the FPC substrate 81 and the wiring substrate 43 are fixed using the main plate 54 and the screw 83. This improves the accuracy of positioning these parts.

Figure 37:
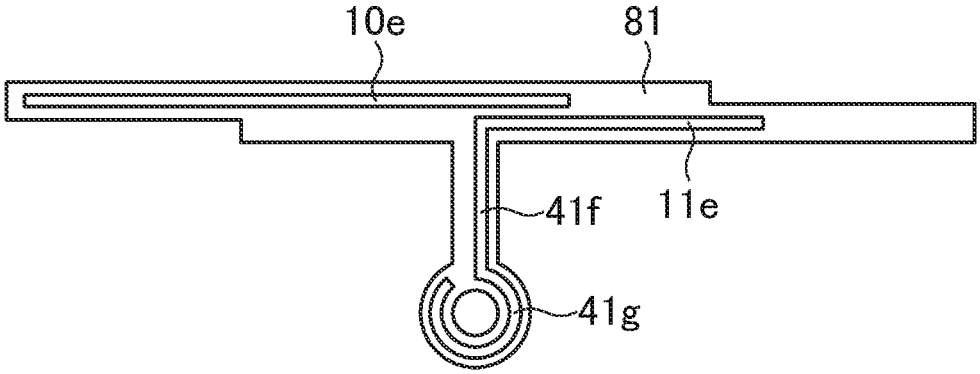
FIG. 37 is a plan view of another example of the FPC substrate.

FIG. 37 is a plan view of another example of the FPC substrate 81. In the example of FIG. 37, the main part of the FPC substrate 81 includes a first notch and a second notch. The first notch is provided below one end of the antenna 10*e*, which is not adjacent to the feeder electrode lie in the unfolded state of the FPC substrate 81 (in a direction in which the feeder electrode lie is adjacent to the antenna 10*e*). The second notch is provided above one end of the feeder electrode lie, which is not adjacent to the antenna 10*e* in the unfolded state of the FPC substrate 81 (in a direction in which the antenna 10*e* is adjacent to the feeder electrode lie). Further, in a state where the FPC substrate 81 is adhered to the second outer circumferential surface of the watch glass 31, the upper part of the first notch is adjacent to the lower part of the second notch. This enables the both ends of the feeder electrode lie to be adjacent to the antenna 10*e* in an equal distance, which serves to ensure the impedance and the reception characteristics of the antenna 10*e*.

Second Embodiment

In the following, a satellite radio-controlled wristwatch 1 according to the second embodiment of the present invention will be described. The satellite radio-controlled wristwatch 1 according to this embodiment uses hour marks 86 on the dial ring 34 as electrodes for supplying power to an antenna 10*g* in a non-contact manner. In the following, differences between the first embodiment and the second embodiment will be mainly described.

Figure 38:
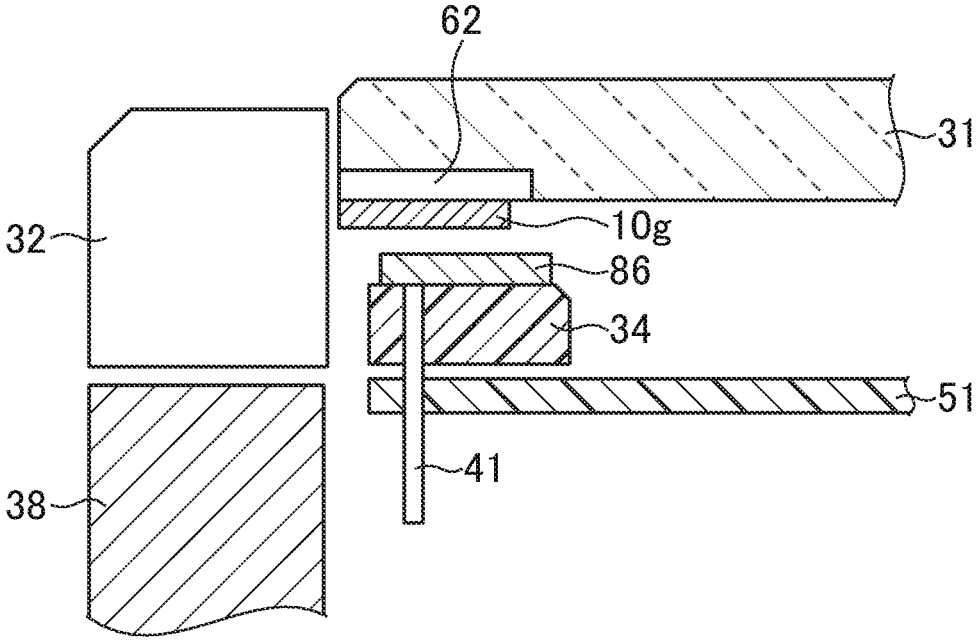
FIG. 38 is a partial sectional view illustrating another example of the satellite radio-controlled wristwatch according to a second embodiment.

FIG. 38 is a partial sectional view illustrating another example of the satellite radio-controlled wristwatch 1 according to the second embodiment. In the example of FIG. 38, the antenna 10*g* is disposed on the lower circumference side of the watch glass 31. More specifically, the hiding area 62 is provided on the circumference of the bottom surface of the watch glass 31, and the antenna 10*g* is provided on the bottom surface of the hiding area 62. The conductive hour marks 86 are disposed on the upper surface of the dial ring 34. The hour marks 86 oppose to the antenna 10*g* and overlap the antenna 10*g* in a plan view. The hour marks 86 are connected to the balun circuit 21 and the receiving circuit 22 via the conductive pin 41. In the example of FIG. 38, the electrode supplying power to the antenna 10*g* is the hour mark 86, and is thus less likely to be recognizable as an electrode by users. This helps to improve design qualities.

Figure 39:
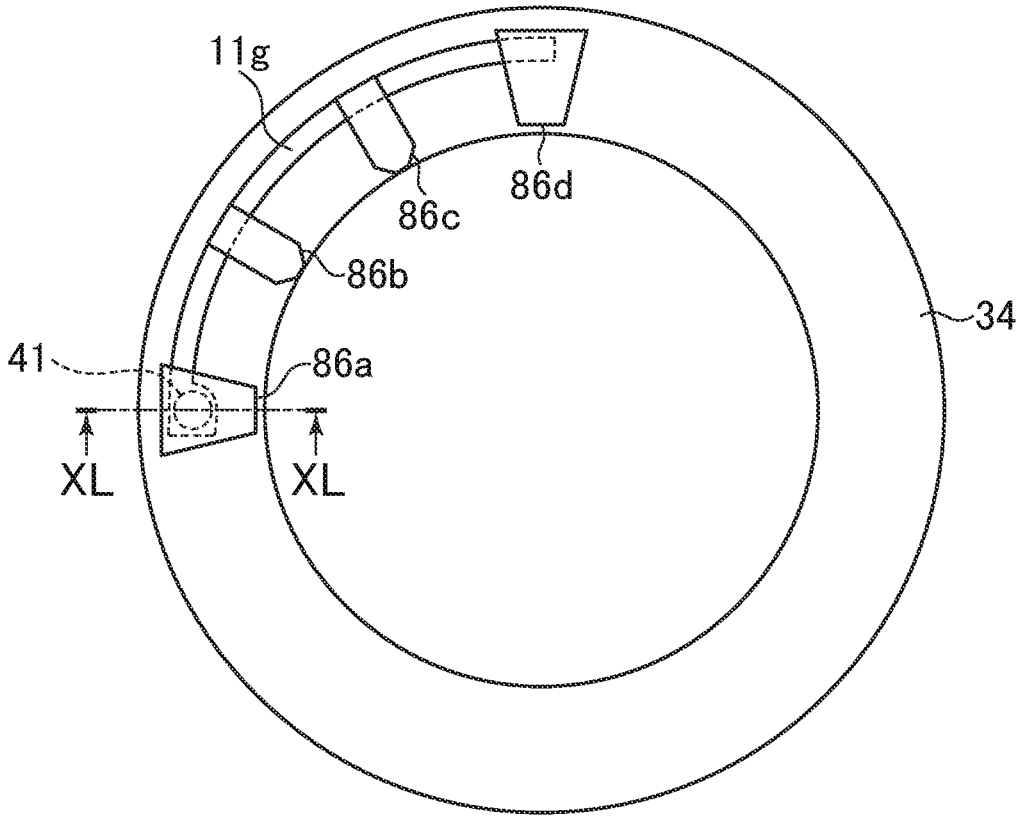
FIG. 39 is a plan view of an example of a dial ring, hour marks, and a feeder electrode.
Figure 40:
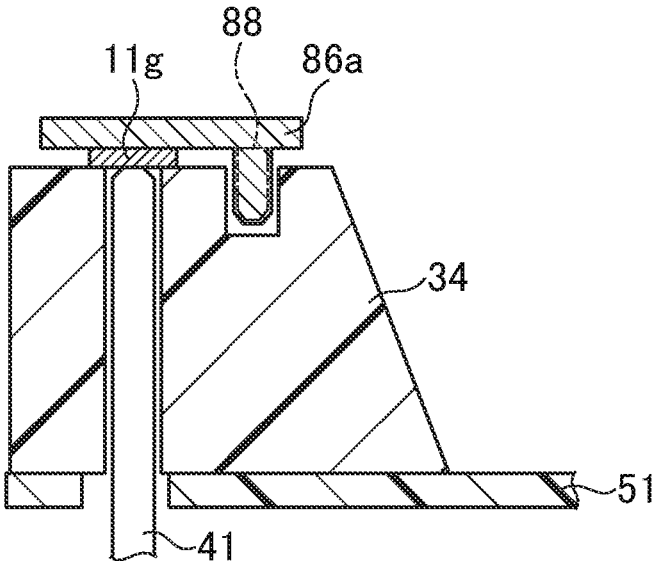
FIG. 40 is a cross-sectional view of the satellite radio-controlled wristwatch shown in FIG. 39 taken along the line XL-XL.

FIG. 39 is a plan view of examples of the dial ring 34, the hour marks 86*a* to 86*d*, and the feeder electrode 11*g*, and FIG. 40 is a cross-sectional view of FIG. 39 taken along the line XL-XL. For simplicity, FIG. 39 shows the dial ring 34 thicker than it would appear. In the examples of FIGS. 39 and 40, the arc-shaped feeder electrode 11*g* is provided on the upper surface of the dial ring 34, and the conductive hour marks 86*a* to 86*d* are disposed so as to be in contact with the upper surface of the feeder electrode 11*g*. In the examples of FIGS. 39 and 40, the hour marks 86*a* to 86*d* are disposed at positions respectively indicating 9 o'clock to 12 o'clock, and adhered to the dial ring 34.

Each of the hour marks 86*a* to 86*d* has a projection 88 radially inward of the feeder electrode 11*g*, and each projection 88 is fitted into a recess provided on the dial ring 34. The feeder electrode 11*g* and the conductive pin 41 are in contact with each other below the hour mark 86*a*, and the conductive pin 41 extends in a direction away from the watch glass 31 and is connected to the wiring substrate 43 (not shown).

The hour marks 86*a* to 86*d* are made of metal or metallized, and have conductivity. The hour marks 86*a* and 86*d* are larger than the hour marks 86*b* and 86*c* in size. The end of the feeder electrode 11*g* closer to the conductive pin 41 is disposed so as to overlap the hour mark 86*a*, which has a large size, in a plan view. In the examples of FIGS. 39 and 40, the hour marks 86*a* to 86*d* are thin and constant in thickness. This prevents changes in distances from the antenna 10*g* to the feeder electrode 11*g* and the hour marks 86*a* to 86*d*, and antenna characteristics from being lowered.

In the examples of FIGS. 39 and 40, the positions of the hour marks 86*a* to 86*d* are less restrictive compared with the example of FIG. 38, and the conductive pin 41 can be readily positioned. The feeder electrode 11*g* can be less recognizable to users by providing prints having the same color as the dial ring 34 or using prints of mode, remaining battery power, and amount of power generation for displays.

Figure 41:
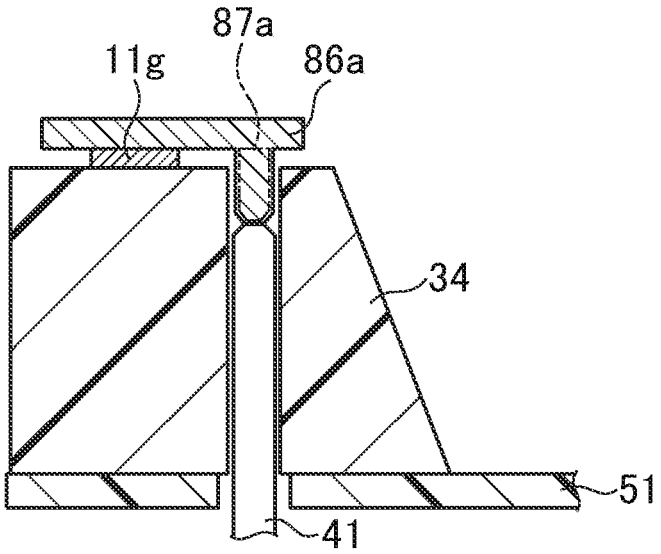
FIG. 41 is a partial sectional view illustrating another example of the satellite radio-controlled wristwatch.

FIG. 41 is a partial sectional view illustrating another example of the satellite radio-controlled wristwatch 1. FIG. 41 corresponds to FIG. 40. In the example of FIG. 41, unlike the example of FIG. 40, the hour mark 86*a* is directly in contact with the conductive pin 41. More specifically, the hour mark 86*a* includes a projection 87*a* that is disposed radially inward of the feeder electrode 11*g* and extends downward, and the dial ring 34 includes a through hole in which the projection 87*a* is inserted and vertically penetrates the dial ring 34. The conductive pin 41 is also inserted in the through hole, and the projection 87*a* is directly in contact with the conductive pin 41 in the through hole. In the example of FIG. 41, the feeder electrode 11*g* is electrically connected to the conductive pin 41 via the hour mark 86*a*.

In the example of FIG. 41, the conductive pin 41 is in contact with the hour mark 86*a*. The hour mark 86*a* can be more highly stressed than the feeder electrode 11*g*, and thus prevents the feeder electrode 11*g* from being deformed due to contact with the conductive pin 41, and increases impact resistance.

Figure 42:
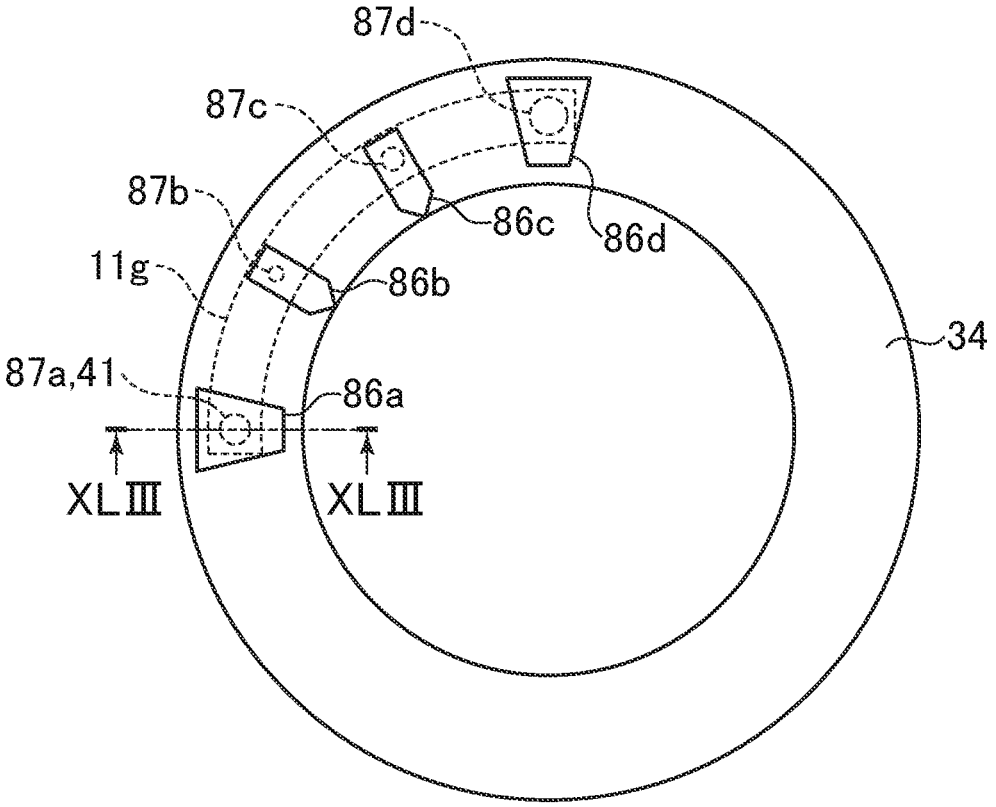
FIG. 42 is a plan view of an example of the dial ring, the hour marks, and the feeder electrode.
Figure 43:
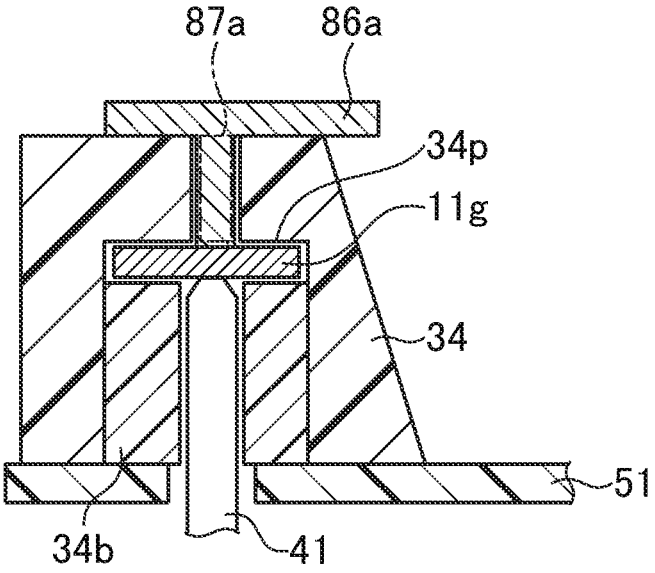
FIG. 43 is a cross-sectional view of the satellite radio-controlled wristwatch shown in FIG. 42 taken along the line XLIII-XLIII.

FIG. 42 is a plan view of examples of the dial ring 34, the hour marks 86*a* to 86*d*, and the feeder electrode 11*g*, and FIG. 43 is a cross-sectional view of FIG. 42 taken along the line XLIII-XLIII. In the example of FIG. 42, unlike the example of FIG. 39, the feeder electrode 11*g* is disposed on the back side of the upper surface of the dial ring 34. The bottom of the dial ring 34 has an arc-shaped recess in a plan view, and the arc-shaped feeder electrode 11*g* is disposed so as to be in contact with the upper end face 34*p* of the arc-shaped recess in a plan view. A spacer 34*b* having vertically penetrating through holes are disposed inside the recess, and the feeder electrode 11*g* is disposed between the upper end face 34*p* and the spacer 34*b*. The conductive pin 41 is inserted in the through hole of the spacer 34*b*, and is in contact with the bottom surface of the feeder electrode 11*g*. The hour marks 86*a* to 86*d* respectively include projections 87*a* to 87*d* projecting downward, and the projections 87*a* to 87*d* are inserted in the through holes penetrating the upper surface of the dial ring 34 and the upper end face 34*p*. The ends of the projections 87*a* to 87*d* are adhered so as to conduct to the feeder electrode 11*g*.

In the examples of FIGS. 42 and 43, the feeder electrode 11*g* is not visible from the above. This helps to improve design qualities. The hour marks 86*a* to 86*d* are in conduction with the feeder electrode 11*g* through the projections 87*a* to 87*d*, and thus distances between the hour marks 86*a* to 86*d* and the antenna 10*g* can be adjusted by adjusting the lengths of the projections 87*a* to 87*d*. By thus adjusting the distances, electromagnetic coupling between the antenna 10*g* and the electrode that electromagnetically feeds the antenna 10*g* can be adjusted, and desired antenna characteristics can be readily obtained. The distance between the dial ring 34 and the watch glass 31 is variable due to the number of hands provided on the satellite radio-controlled wristwatch 1, for example. In this case as well, by adjusting the lengths of the projections 87*a* to 87*d*, it is possible to prevent changes in antenna characteristics due to the distance between the antenna 10*g* and the electrode feeding the antenna 10*g*. The spacer 34*b* is formed of high dielectric ceramics, and thus the feeder electrode 11*g* can be made shorter and smaller by the wavelength-shortening effect.

Figure 44:
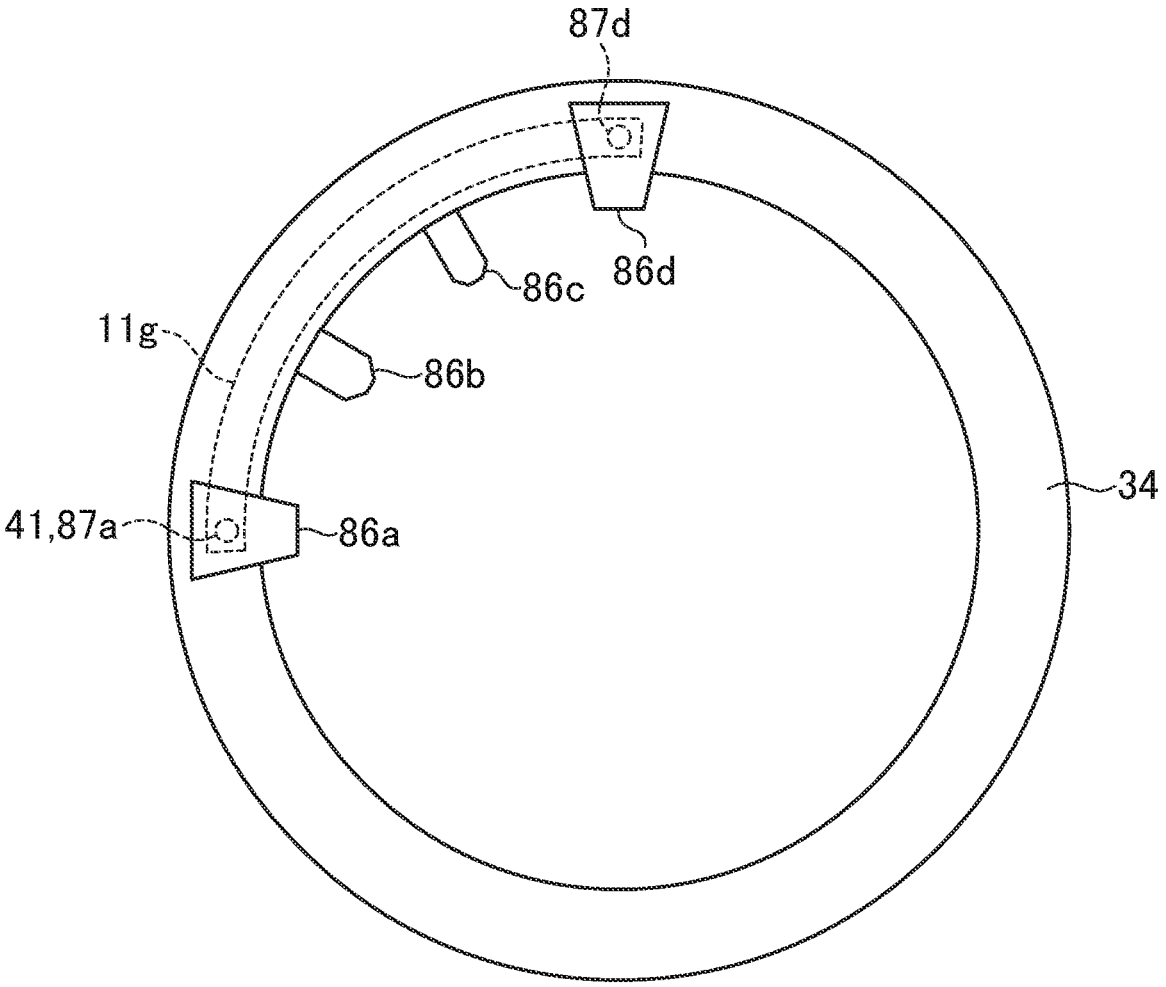
FIG. 44 is a plan view of another example of the dial ring, the hour marks, and the feeder electrode.

FIG. 44 is a plan view of other examples of the dial ring 34, the hour marks 86*a* to 86*d*, and the feeder electrode 11*g*. In the example of FIG. 44, unlike the examples of FIGS. 42 and 43, the both ends of the feeder electrode 11*g* are electrically connected to the hour marks 86*a* and 86*d*, which respectively have large areas, and the hour marks 86*b* and 86*c*, which respectively have small areas, are not electrically connected to the feeder electrode 11*g*.

In the example of FIG. 44, one end of the feeder electrode 11*g* further away from the conductive pin 41 is connected to the hour mark 86*d*. The hour mark 86*d* thus generates an effect of so-called capacity hat, and can lower resonant wavelength relating to the feeder electrode 11*g*. This can reduces the line length of the feeder electrode 11*g*. In a case where the feeder electrode 11*g* is disposed inside of the dial ring 34, the feeder electrode 11*g* gets closer to conductive members, such as a train wheel, in the movement. Such influence can be reduced by reducing the line length of the feeder electrode 11*g*.

Figure 45:
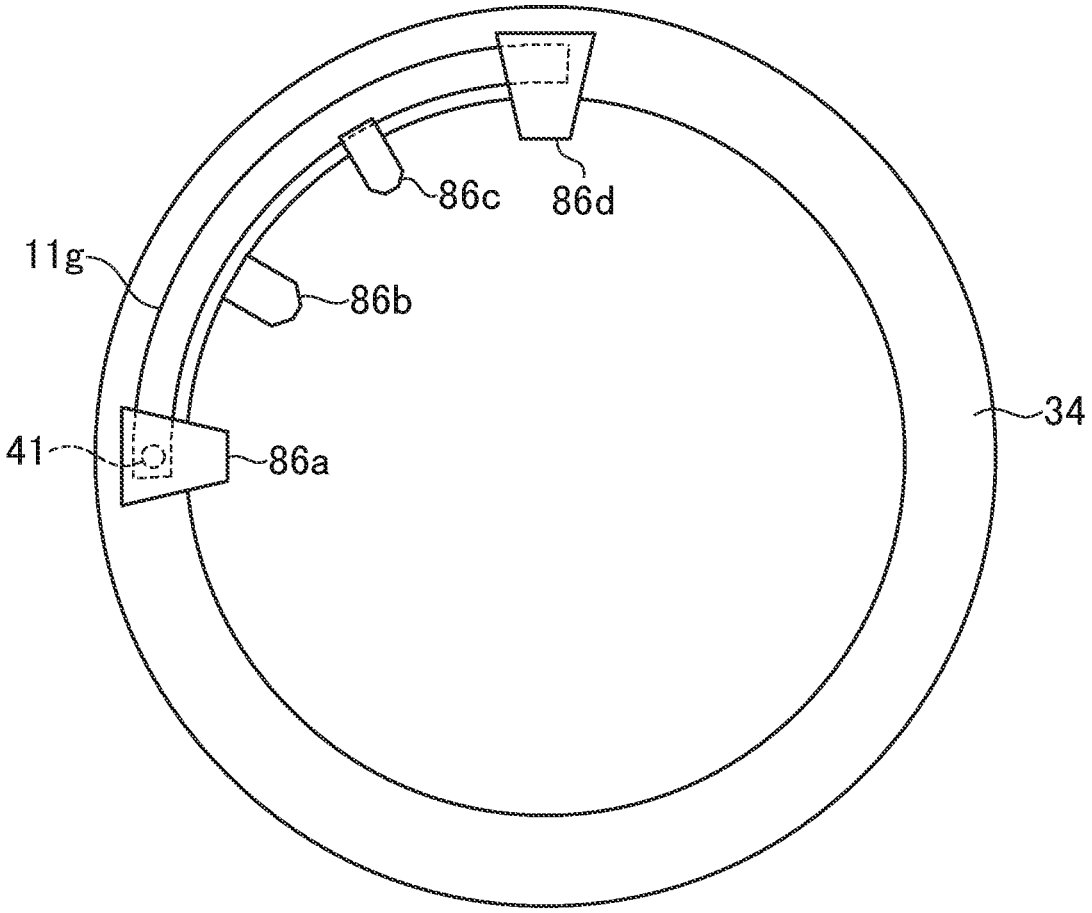
FIG. 45 is a plan view of another example of the dial ring, the hour marks, and the feeder electrode.

FIG. 45 is a plan view of other examples of the dial ring 34, the hour marks 86*a* to 86*d*, and the feeder electrode 11*g*. Unlike the example of FIG. 39, the example of FIG. 45 includes the hour marks 86*a*, 86*c*, and 86*d* that are electrically connected to the feeder electrode 11*g*, and the hour mark 86*b* that is not electrically connected to the feeder electrode 11*g*. Here, an insulating sheet may be disposed between the feeder electrode 11*g* and the hour mark 86*b* that is not connected to the feeder electrode 11*g* so as to avoid electrical connection.

According to the example of FIG. 45, if the distance between the upper surface of the dial ring 34 and the watch glass 31 is changed, the impedance of the antenna can be adjusted by adjusting the number or positions of hour marks 86 that are connected to the feeder electrode 11*g*. More specifically, when the feeder electrode 11*g* is electrically connected to the hour mark 86, unevenness is generated between the antenna 10*g* and the combination of the feeder electrode 11*g* and the hour mark 86. The impedance can be adjusted by this electromagnetic effect of unevenness, and the impedance of the antenna can be matched. The hour mark 86 that is not connected to the feeder electrode may be appropriately selected according to its antenna characteristics.

FIG. 45 shows an example in which the feeder electrode 11*g* is disposed on the upper surface of the dial ring 34, although the feeder electrode 11*g* may be disposed inside of the dial ring 34 as shown in FIG. 42. The example FIG. 42 can provide the same advantage as the example of FIG. 45 by selecting the hour marks 86 electrically connected to the feeder electrode 11*g*. Regarding the hour mark 86*b* (or may be another hour mark) that is not connected to the feeder electrode 11*g*, the length of its projection 87*b* may be shortened so as not to be in contact with the feeder electrode 11*g*.

In the second embodiment, the hour marks of 9 o'clock to 12 o'clock are described in the example, although the length of the feeder electrode 11*g* may be shorter or longer than the length from the 9 o'clock to 12 o'clock. Further, the positions of the connected hour marks may not be limited to the positions from 9 o'clock to 12 o'clock, and the number of the connected hour marks is not limited. The method for using a hour mark as a part of a feeder electrode to supply power to an antenna is not limited to be applied to an annular antenna, but may be also applied to a dipole antenna, a patch antenna, an inverted F antenna, and a slot antenna.

The case has been explained in which the present invention is applied to the satellite radio-controlled wristwatch 1, although the present invention may be also applied to a portable small timepiece different from a wristwatch, for example.

The invention claimed is:

1. A portable radio-controlled watch comprising:

a watch glass;

an antenna that is disposed on a surface of a circumference of the watch glass;

a feeder electrode that is adjacent to the antenna on one side of the watch glass and in a direction perpendicular to a thickness direction of the antenna;

a receiving circuit;

an antenna connecting line that is at least a part of a connection circuit connecting the feeder electrode with the receiving circuit, the antenna connecting line being electrically connected to the feeder electrode and extending in a direction away from the watch glass;

a dielectric that is disposed near the antenna and covers at least a part of the antenna in a plan view; and wherein the antenna and the feeder electrode are capacitively coupled.

2. The portable radio-controlled watch according to claim 1, wherein the antenna includes a first part that is adjacent to the feeder electrode and a second part that is not adjacent to the feeder electrode, and a width of the first part is smaller than a width of the second part.

3. The portable radio-controlled watch according to claim 1, wherein the antenna is not disposed on the circumference side of an area of the feeder electrode and on a side opposite to the area of the feeder electrode, where the area of the feeder electrode is in contact with the antenna connecting line.

4. The portable radio-controlled watch according to claim 1, wherein the antenna is disposed closer to the circumference side of the watch glass than the feeder electrode.

5. The portable radio-controlled watch according to claim 1, wherein the feeder electrode is disposed closer to the circumference side of the watch glass than the antenna.

6. The portable radio-controlled watch according to claim 5, further comprising a bezel or a body into which the watch glass is fitted, wherein the bezel or the body has a notch at a position opposite to the antenna connecting line.

7. The portable radio-controlled watch according to claim 1, further comprising a bezel into which the watch glass is fitted, wherein the dielectric is a part of the bezel and disposed immediately below the antenna.

8. The portable radio-controlled watch according to claim 1, further comprising a bezel into which the watch glass is fitted, wherein the dielectric is a part of the bezel, and an insulating member is disposed between the antenna and the dielectric.

9. The portable radio-controlled watch according to claim 1, further comprising:

a bezel into which the watch glass is fitted and including a dielectric disposed below the antenna; and a high dielectric member that is disposed between the dielectric and the antenna, and has a higher permittivity than the dielectric.

10. The portable radio-controlled watch according to claim 1, further comprising a bezel into which the watch glass is fitted and including a metal member and a dielectric member.

11. The portable radio-controlled watch according to claim 1, further comprising a hiding member between the antenna and the watch glass.

12. The portable radio-controlled watch according to claim 1, wherein the circumference of the watch glass is inclined at a front side.

13. A portable radio-controlled watch comprising:

a watch glass;

an antenna that is disposed on a surface of a circumference of the watch glass;

a feeder electrode that is adjacent to the antenna on one side of the watch glass and in a direction perpendicular to a thickness direction of the antenna;

a receiving circuit;

an antenna connecting line that is at least a part of a connection circuit connecting the feeder electrode with the receiving circuit, the antenna connecting line being electrically connected to the feeder electrode and extending in a direction away from the watch glass;

a dielectric that is disposed near the antenna and covers at least a part of the antenna in a plan view; and wherein the antenna and the feeder electrode are wirelessly connected.

* * * * *